US010639892B2

(12) United States Patent
Matsumoto

(10) Patent No.: US 10,639,892 B2
(45) Date of Patent: May 5, 2020

(54) LIQUID EJECTING APPARATUS

(71) Applicant: SEIKO EPSON CORPORATION, Tokyo (JP)

(72) Inventor: Yusuke Matsumoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/260,197

(22) Filed: Jan. 29, 2019

(65) Prior Publication Data

US 2019/0232656 A1 Aug. 1, 2019

(30) Foreign Application Priority Data

Jan. 31, 2018 (JP) ..... 2018-015775

(51) Int. Cl.
*B41J 2/045* (2006.01)
*B41J 2/14* (2006.01)

(52) U.S. Cl.
CPC ..... *B41J 2/14233* (2013.01); *B41J 2/0455* (2013.01); *B41J 2/04541* (2013.01); *B41J 2/04551* (2013.01); *B41J 2/04581* (2013.01); *B41J 2/04588* (2013.01); *B41J 2/04593* (2013.01); *B41J 2/04596* (2013.01)

(58) Field of Classification Search
CPC .. B41J 2/14233; B41J 2/0455; B41J 2/04588; B41J 2/04541; B41J 2/04581; B41J 2/04596; B41J 2/04593; B41J 2/04551
See application file for complete search history.

(56) References Cited

U.S. PATENT DOCUMENTS

2006/0044337 A1* 3/2006 Takata ..... 347/14
2007/0046703 A1 3/2007 Tamura
2016/0221332 A1 8/2016 Sano
2017/0057221 A1 3/2017 Nozawa
2017/0087828 A1 3/2017 Hayashi et al.

FOREIGN PATENT DOCUMENTS

JP 2017-043007 A 3/2017

OTHER PUBLICATIONS

IP.com search (Year: 2019).*
The Extended European Search Report for the corresponding European Patent Application No. 19154919.5 dated Jul. 5, 2019.

* cited by examiner

*Primary Examiner* — Henok D Legesse
(74) *Attorney, Agent, or Firm* — Global IP Counselors, LLP

(57) ABSTRACT

A liquid ejecting apparatus includes a drive circuit in which a first voltage signal is output from an output terminal, a piezoelectric element that includes a first electrode to which the first voltage signal is supplied and a second electrode to which a second voltage signal is supplied and is displaced by a potential difference between the first electrode and the second electrode, a cavity which is filled with a liquid, a vibration plate that is provided between the cavity and the piezoelectric element, and a switch element that is electrically connected to the output terminal and the first electrode. The liquid ejecting apparatus has a mode in which the switch element is controlled to be turned off, and a voltage value of the first voltage signal is controlled to approximate a voltage value of the second voltage signal.

9 Claims, 20 Drawing Sheets

FIG. 4

| OPERATION MODE | | PRINT MODE | STANDBY MODE | TRANSITION MODE | SLEEP MODE |
|---|---|---|---|---|---|
| STATE SIGNAL | MC1 | H | H | L | L |
| | MC2 | H | L | L | H |

FIG. 13

| OPERATION MODE | | PRINT MODE | | | | STANDBY MODE | TRANSITION MODE | SLEEP MODE |
|---|---|---|---|---|---|---|---|---|
| | | LARGE DOT | MEDIUM DOT | SMALL DOT | MINUTE VIBRATION | | | |
| [SIH, SIL] | | [1, 1] | [1, 0] | [0, 1] | [0, 0] | – | – | – |
| MC1 | | H | | | | H | L | L |
| MC2 | | H | | | | L | L | H |
| S | T1 | H | H | L | L | H | H | L |
| | T2 | H | L | H | L | | | |
| | T3 | L | L | L | H | | | |

LIQUID EJECTING APPARATUS

The entire disclosure of Japanese Patent Application No. 2018-015775, filed Jan. 31, 2018 is expressly incorporated by reference herein.

BACKGROUND

1. Technical Field

The present invention relates to a liquid ejecting apparatus.

2. Related Art

It is known that a piezoelectric element such as a piezo element is used as an ink jet printer (liquid ejecting apparatus) which ejects a liquid such as ink to print an image or a document. The piezoelectric element is provided in the print head, corresponding to a plurality of nozzles that eject the ink and a cavity that stores the ink ejected from the nozzles. As the piezoelectric element is displaced according to a drive signal, a vibration plate provided between the piezoelectric element and the cavity is displaced, and the volume of the cavity changes. Thereby, the predetermined amount of ink is ejected from the nozzle at a predetermined timing, and dots are formed on a medium.

JP-A-2017-43007 discloses a liquid ejecting apparatus in which a drive signal generated based on print data is supplied to an upper electrode and a reference voltage is supplied to a lower electrode for a piezoelectric element that is displaced based on a potential difference between the upper electrode and the lower electrode, and which controls a displacement of the piezoelectric element by controlling whether or not the drive signal is supplied by a selection circuit (switch circuit) and ejects ink.

In addition to a print state in which ink can be ejected as described above, the liquid ejecting apparatus also has a state in which print data is not supplied and ink is not ejected. The state in which ink is not ejected include a plurality of states, such as, a standby state in which it is possible to shift to a print state in a short time in a case where the print data is supplied, a sleep state in which power consumption is reduced for the standby state, and a transition state to be performed while the standby state is shifted to the sleep state. A piezoelectric element is displaced in a case where a potential difference is generated between an upper electrode and a lower electrode even in a state where the ink is not ejected.

Particularly, in the sleep state, the switch circuit may be controlled to be turned off so as to reduce power consumption. However, in a case where the switch circuit is controlled to be turned off, a leakage current may flow through a resistance component included in the switch circuit and a resistance component of the piezoelectric element. As a result, an unintended potential difference is generated between the upper electrode and the lower electrode of the piezoelectric element, and the piezoelectric element is displaced. Such an unintentional displacement of the piezoelectric element may cause larger bending than expected in the vibration plate.

The sleep state may continue for a long time with respect to the print state or the like. Accordingly, in a case where the unintended displacement occurs in the piezoelectric element in the sleep state and the larger bending than expected occurs in the vibration plate, an unintended stress is continuously applied to the vibration plate.

In a case where the sleep state is shifted to the print state in a state where the larger bending occurs than expected in the vibration plate, a load more than necessary is applied to the vibration plate at the time of ejecting the ink. The stress and load on the vibration plate occur around a contact point between the vibration plate and the cavity. As a result, a crack or the like may occur in the vibration plate.

In a case where the crack occurs in the vibration plate, the ink stored in the cavity leaks out from the crack, and the amount of ejected ink may fluctuate depending on a change in the volume of cavity. As a result, ink ejection accuracy is decreased.

Furthermore, in a case where the ink leaked from the crack adheres to both the upper electrode and the lower electrode, current flows through the ink between the upper electrode and the lower electrode. Accordingly, a potential of a reference voltage supplied to the lower electrode varies. As a result, for example, in a case where the reference voltage is commonly supplied to a plurality of piezoelectric elements, the variation in the potential of the reference voltage affects the displacement of the plurality of piezoelectric elements. That is, the ejection accuracy of the entire liquid ejecting apparatus may be affected, not limited to the ejection accuracy from the nozzle corresponding to the vibration plate in which the crack occurs.

A problem caused by the displacement of the piezoelectric element and unintended bending occurring in the vibration plate in a state where the ink is not ejected is a new problem not disclosed in JP-A-2017-43007.

SUMMARY

The invention can be realized in the following aspects.

According to an aspect of the invention, a liquid ejecting apparatus includes a drive circuit in which a first voltage signal is output from an output terminal, a piezoelectric element that includes a first electrode to which the first voltage signal is supplied and a second electrode to which a second voltage signal is supplied and is displaced by a potential difference between the first electrode and the second electrode, a cavity which is filled with a liquid that is ejected from a nozzle in accordance with the displacement of the piezoelectric element, a vibration plate that is provided between the cavity and the piezoelectric element, and a switch element that is electrically connected to the output terminal and the first electrode. The liquid ejecting apparatus has a mode in which a liquid is not ejected, the switch element is controlled to be turned off, and a voltage value of the first voltage signal is controlled to approximate a voltage value of the second voltage signal.

In the liquid ejecting apparatus, a plurality of nozzles may be provided at a density of 300 or more per inch, and a plurality of piezoelectric elements may be provided corresponding to the plurality of nozzles.

In the liquid ejecting apparatus, printing may not be performed on a medium in the mode.

In the liquid ejecting apparatus, a third voltage signal having a voltage value higher than the voltage value of the first voltage signal and the voltage value of the second voltage signal may be input to a node which is electrically connected to the output terminal and the switch element, via a resistance element.

In the liquid ejecting apparatus, a resistance component of the piezoelectric element may be larger than a resistance component when the switch element is turned off.

In the liquid ejecting apparatus, the drive circuit may include a feedback circuit that feeds back the first voltage signal which is output from the output terminal, a modulation circuit that generates a modulation signal, based on an original signal which is a source of the first voltage signal and a signal which is obtained by feeding back the first voltage signal, and an output circuit that generates the first voltage signal by amplifying and demodulating the modulation signal.

BRIEF DESCRIPTION OF THE DRAWINGS

The invention will be described with reference to the accompanying drawings, wherein like numbers reference like elements.

FIG. 4 is a diagram illustrating a relationship between state signals and each operation mode.

FIG. 13 is a diagram illustrating decoded content.

DESCRIPTION OF EXEMPLARY EMBODIMENTS

Preferred embodiments of the invention will be described below with reference to the drawings. The drawings which are used are for the sake of convenience. The embodiments which will be described below do not unduly limit the content of the invention described in the claims. In addition, not all configurations which will be described below are essential configuration elements of the invention.

Hereinafter, an ink jet printer, which is a print apparatus that ejects ink as a liquid, will be described as an example of a liquid ejecting apparatus according to the invention.

Examples of the liquid ejecting apparatus include a print apparatus such as a printer, a color material ejecting apparatus used for manufacturing a color filter of a liquid crystal display or the like, an electrode material ejecting apparatus used for forming an electrode of an organic EL display, a surface emitting display, or the like, a biological organic material ejecting apparatus used for manufacturing a biochip, and the like.

1. Outline of Liquid Ejecting Apparatus

A print apparatus which is an example of a liquid ejecting apparatus according to the present embodiment is an ink jet printer that forms dots on a print medium such as paper by ejecting ink in accordance with image data supplied from an external host computer, thereby, printing an image including characters, a graphic, and the like according to the image data.

Figure 1:
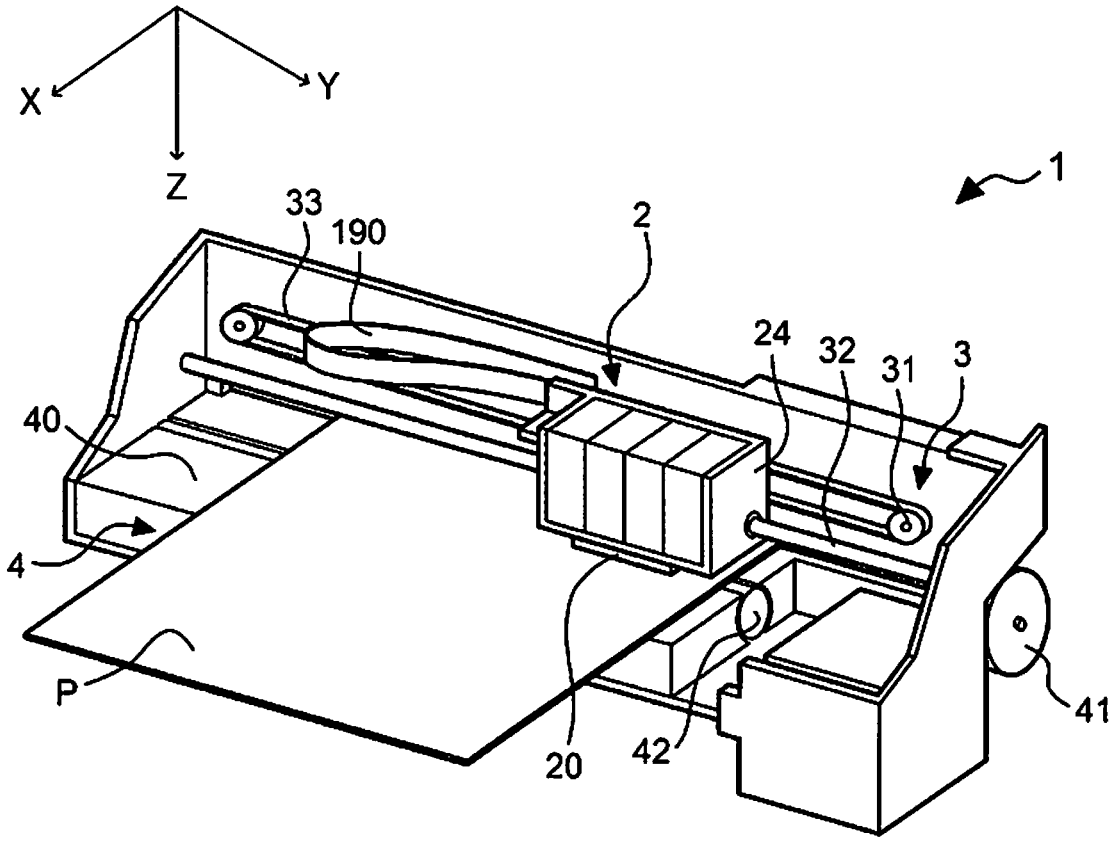
FIG. 1 is a perspective view illustrating a schematic configuration of a liquid ejecting apparatus.

FIG. 1 is a perspective view illustrating a schematic configuration of a liquid ejecting apparatus 1. In FIG. 1, a direction in which a medium P is transported is defined as a direction X, a direction which intersects the direction X and in which a moving object 2 reciprocates is defined as a direction Y, and a direction in which ink is ejected is defined as a direction Z. In the present embodiment, it is described that the directions X, Y, and Z are orthogonal to each other.

As illustrated in FIG. 1, the liquid ejecting apparatus 1 includes the moving object 2 and a moving mechanism 3 that reciprocates the moving object 2 in the direction Y.

The moving mechanism 3 includes a carriage motor 31 which is a drive source of the moving object 2, a carriage guide shaft 32 having both ends fixed, and a timing belt 33 that extends substantially in parallel with the carriage guide shaft 32 and is driven by the carriage motor 31.

The carriage 24 included in the moving object 2 is supported by the carriage guide shaft 32 reciprocably and is fixed to a part of the timing belt 33. By driving the timing belt 33 by using the carriage motor 31, the moving object 2 reciprocates along the direction Y while being guided by the carriage guide shaft 32.

A head unit 20 is provided in a portion of the moving object 2 that faces the medium P. As will be described below, the head unit 20 includes many nozzles, and ejects ink from the nozzles in the direction Z. In addition, various control signals and the like are supplied to the head unit 20 via a flexible cable 190.

The liquid ejecting apparatus 1 includes a transport mechanism 4 for transporting the medium P on the platen 40 in the direction X. The transport mechanism 4 includes a transport motor 41 which is a drive source and a transport roller 42 which is rotated by the transport motor 41 and transports the medium P in the direction X.

At the timing when the medium P is transported by the transport mechanism 4, the head unit 20 ejects ink onto the medium P, and thereby, an image is formed on a surface of the medium P.

Figure 2:
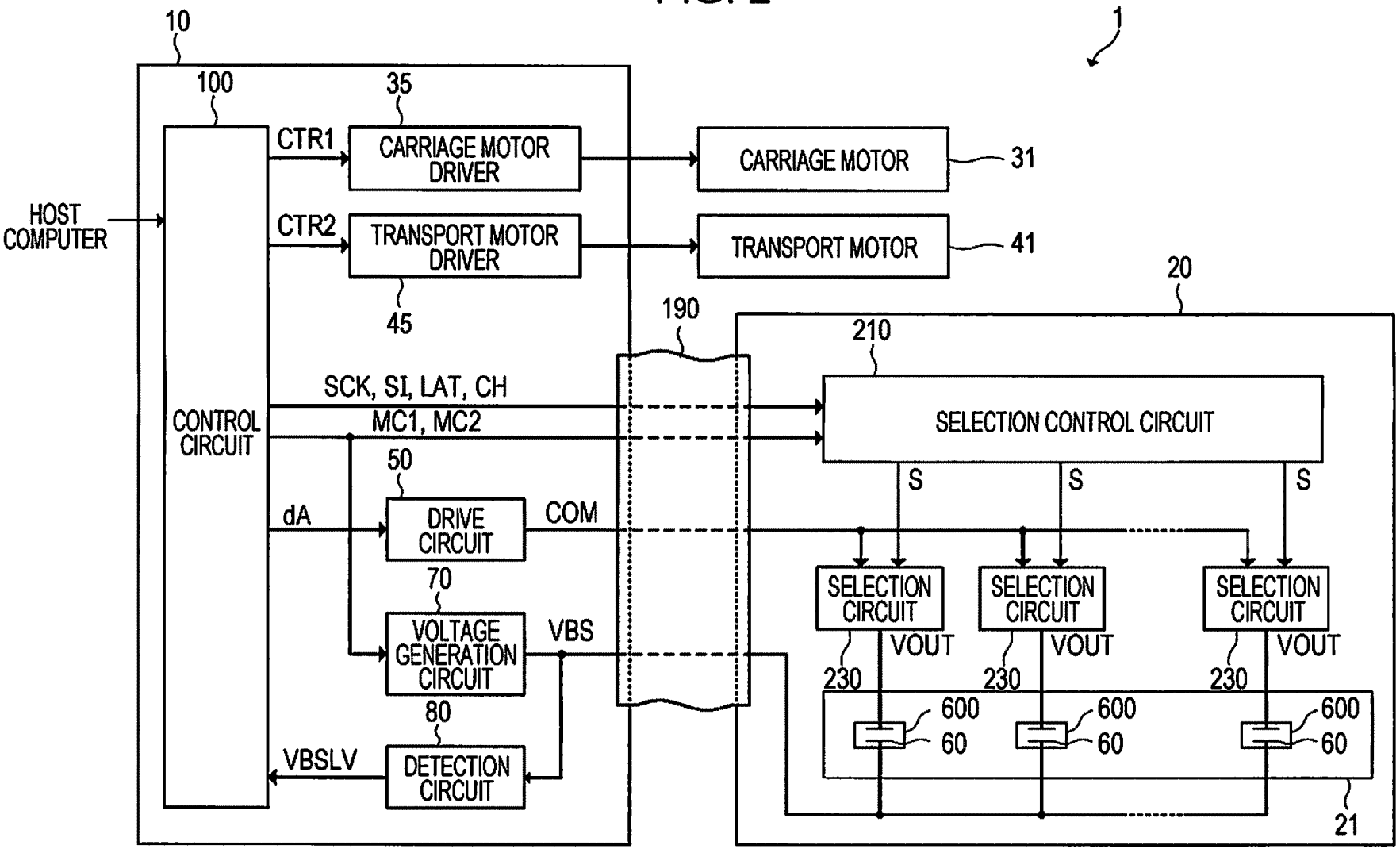
FIG. 2 is a block diagram illustrating an electrical configuration of the liquid ejecting apparatus.

FIG. 2 is a block diagram illustrating an electrical configuration of the liquid ejecting apparatus 1.

As illustrated in FIG. 2, the liquid ejecting apparatus 1 includes a control unit 10 and the head unit 20. The control unit 10 and the head unit 20 are connected to each other via the flexible cable 190.

The control unit 10 includes a control circuit 100, a carriage motor driver 35, a transport motor driver 45, a drive circuit 50, a voltage generation circuit 70, and a detection circuit 80.

The control circuit 100 outputs a plurality of control signals and the like for controlling various configurations, based on image data supplied from a host computer.

Specifically, the control circuit 100 supplies a control signal CTR1 to the carriage motor driver 35. The carriage motor driver 35 drives a carriage motor 31 in response to the control signal CTR1. Thereby, movement of the carriage 24 in the direction Y is controlled.

In addition, the control circuit 100 supplies a control signal CTR2 to the transport motor driver 45. The transport motor driver 45 drives the transport motor 41 in response to the control signal CTR2. Thereby, movement, which is made by the transport mechanism 4, in the direction X is controlled.

In addition, the control circuit 100 supplies data dA which is a digital signal to the drive circuit 50. As will be described in detail below, the drive circuit 50 performs an analog conversion of the data dA, performs a class-D amplification of the data dA to generate a drive signal COM, and supplies the drive signal to the head unit 20. That is, the data dA is a signal for defining a waveform of the drive signal COM to be supplied to the head unit 20.

In addition, the control circuit 100 supplies state signal MC1 and MC2 to the voltage generation circuit 70. The voltage generation circuit 70 generates a reference voltage signal VBS based on the state signals MC1 and MC2. The reference voltage signal VBS is branched by the control unit 10 and is supplied to the detection circuit 80 and the head unit 20. The detection circuit 80 detects a voltage value of the supplied reference voltage signal VBS and supplies a reference voltage value signal VBSLV indicating the detection result to the control circuit 100.

Furthermore, the control circuit 100 supplies the head unit 20 with a clock signal SCK, a print data signal SI, the state signals MC1 and MC2, a latch signal LAT, and a change signal CH.

The head unit 20 includes a selection control circuit 210, a plurality of selection circuits 230, and a recording head 21. The recording head 21 includes a plurality of ejection units 600 including a piezoelectric element 60. The plurality of ejection units 600 are provided corresponding to the plurality of selection circuits 230.

As will be described in detail below, the selection control circuit 210 instructs each selection circuit 230 whether or not to select the drive signal COM, based on the print data signal SI, the state signals MC1 and MC2, the latch signal LAT, and the change signal CH which are supplied from the control circuit 100.

The selection circuit 230 selects the drive signal COM in accordance with the instruction of the selection control circuit 210 and supplies the selected drive signal COM to one end of the piezoelectric element 60 of the ejection unit 600 included in the recording head 21 as a drive signal VOUT. The reference voltage signal VBS is supplied to the other end of the piezoelectric element 60 in common.

The piezoelectric element 60 included in the ejection unit 600 is provided corresponding to each of the plurality of nozzles in the recording head 21. The piezoelectric element 60 is displaced in accordance with a potential difference between a voltage value of the drive signal VOUT supplied to one end and a voltage value of the reference voltage signal VBS supplied to the other end. Then, the ink according to a change of the potential difference for displacing the piezoelectric element 60 is ejected from the nozzle.

In FIG. 2, it is described that the liquid ejecting apparatus 1 includes one head unit 20, but a plurality of head units 20 may be included. In addition, in FIG. 2, it is described that the head unit 20 includes one recording head 21, but a single head unit 20 may include a plurality of recording heads 21. In addition, the drive circuit 50 may be included in the head unit 20.

Here, the liquid ejecting apparatus 1 according to the present embodiment has a plurality of operation modes.

Specifically, the liquid ejecting apparatus 1 has a print mode, a standby mode, a transition mode, and a sleep mode as at least a part of a plurality of operation modes. The print mode is an operation mode in which printing can be performed by ejecting ink onto the medium P based on the supplied image data. The standby mode is an operation mode in which printing can be restarted in a short time in a case where data is supplied while reducing power consumption with respect to the print mode. The transition mode is an operation mode between the standby mode and the sleep mode. The sleep mode is an operation mode in which power consumption can be further reduced with respect to the standby mode. In the standby mode, transition mode, and the sleep mode, the image data is not supplied and the ink is not ejected onto the medium P, and thus, printing is not performed.

Figure 3:
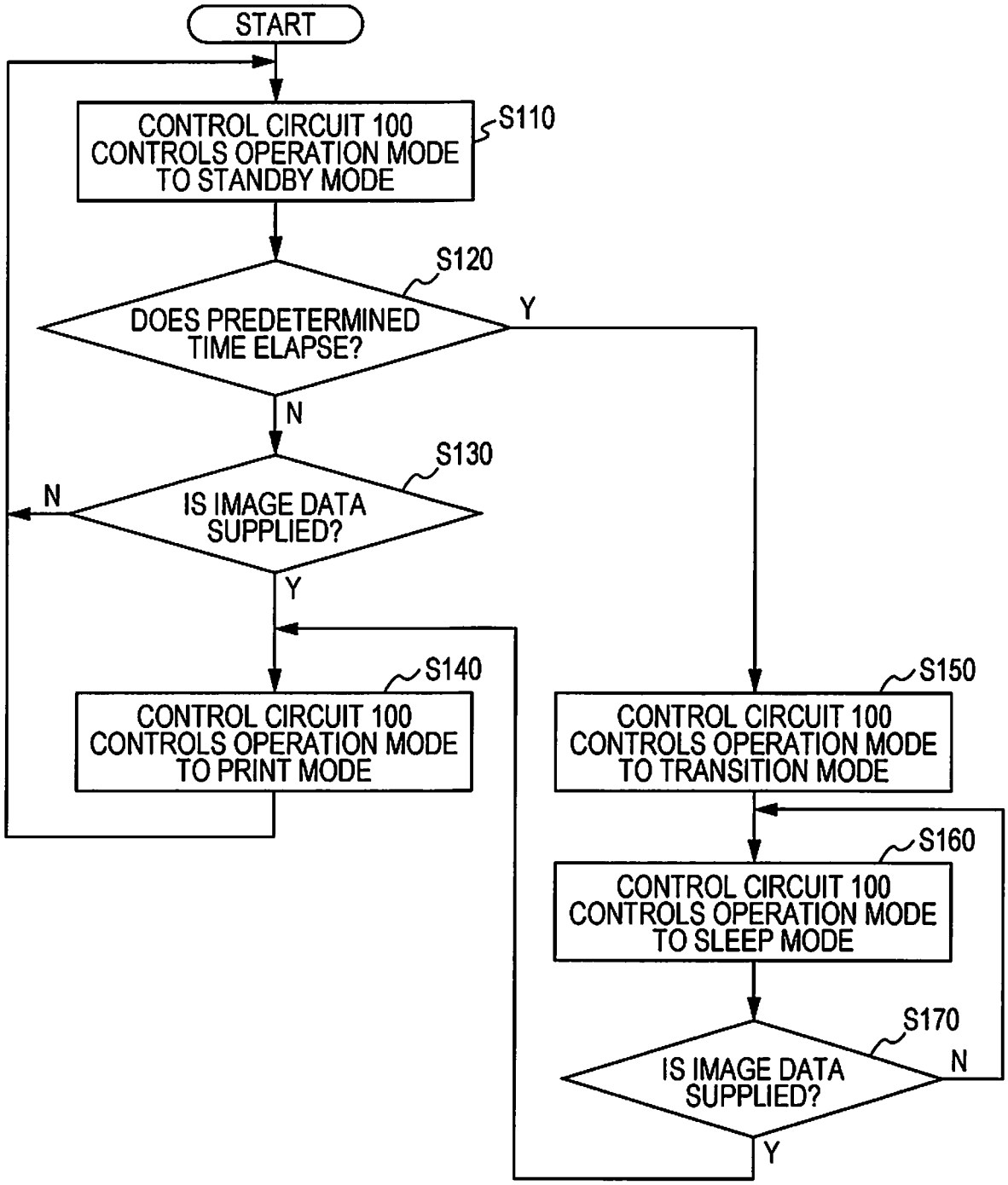
FIG. 3 is a flowchart illustrating a mode transition between operation modes of the liquid ejecting apparatus.

Here, a relationship between the operation modes of the liquid ejecting apparatus 1 will be described with reference to FIG. 3. FIG. 3 is a flowchart illustrating a mode transition of the operation modes of the liquid ejecting apparatus 1.

As illustrated in FIG. 3, if power is supplied to the liquid ejecting apparatus 1, the control circuit 100 controls an operation mode to become the standby mode (S110). After shifting to the standby mode, the control circuit 100 determines whether or not a predetermined time elapses (S120).

In a case where the predetermined time does not elapse (N of S120), the control circuit 100 determines whether image data is supplied to the liquid ejecting apparatus 1 (S130).

In a case where the image data is not supplied (N of S130), the standby mode is maintained. Meanwhile, in a case where the image data is supplied (Y of S130), the control circuit 100 controls an operation mode to become the print mode (S140).

In the print mode, if the printing corresponding to the supplied image data is completed, the control circuit 100 controls the operation mode to become the standby mode (S110).

In a case where the predetermined time elapses (Y of S120), the control circuit 100 controls the operation mode to become the transition mode (S150), and thereafter, controls the operation mode to become the sleep mode (S160).

After shifting to the sleep mode, the control circuit 100 determines whether or not the image data is supplied to the liquid ejecting apparatus 1 (S170).

In a case where the image data is not supplied (N of S170), the sleep mode is maintained. Meanwhile, in a case where the image data is supplied (Y of S170), the control circuit 100 controls the operation mode to become the print mode (S140).

In the present embodiment, the control circuit 100 outputs the state signals MC1 and MC2 indicating which of the print mode, the standby mode, the sleep mode, and the transition mode the liquid ejecting apparatus 1 is in. FIG. 4 is a diagram illustrating a relationship between the state signals MC1 and MC2 and each operation mode.

As illustrated in FIG. 4, in a case where the liquid ejecting apparatus 1 is in the print mode, the control circuit 100 outputs the state signals MC1 and MC2 at an H level. When the liquid ejecting apparatus 1 is in the standby mode, the control circuit 100 outputs the state signals MC1 and MC2 at an H level and an L level, respectively. When the liquid ejecting apparatus 1 is in the transition mode, the control circuit 100 outputs the state signals MC1 and MC2 at the L level. When the liquid ejecting apparatus 1 is in the sleep mode, the control circuit 100 outputs the state signals MC1 and MC2 at an L level and an H level, respectively.

The liquid ejecting apparatus 1 may include operation modes other than the above-described operation modes as the plurality of operation modes. For example, the liquid ejecting apparatus 1 may have operation modes such as a test print mode in which test printing is performed on the medium P, and a stop mode in which an operation stops due to running out of ink, poor transport of the medium P, or the like.

In the present embodiment, it is described that the operation modes of the liquid ejecting apparatus 1 are performed by using two signals of the state signals MC1 and MC2, but the control circuit 100 may perform the operation modes by using three or more signals, or may perform the operation modes by using a specific command.

2. Electrical Configuration of Drive Circuit

Figure 5:
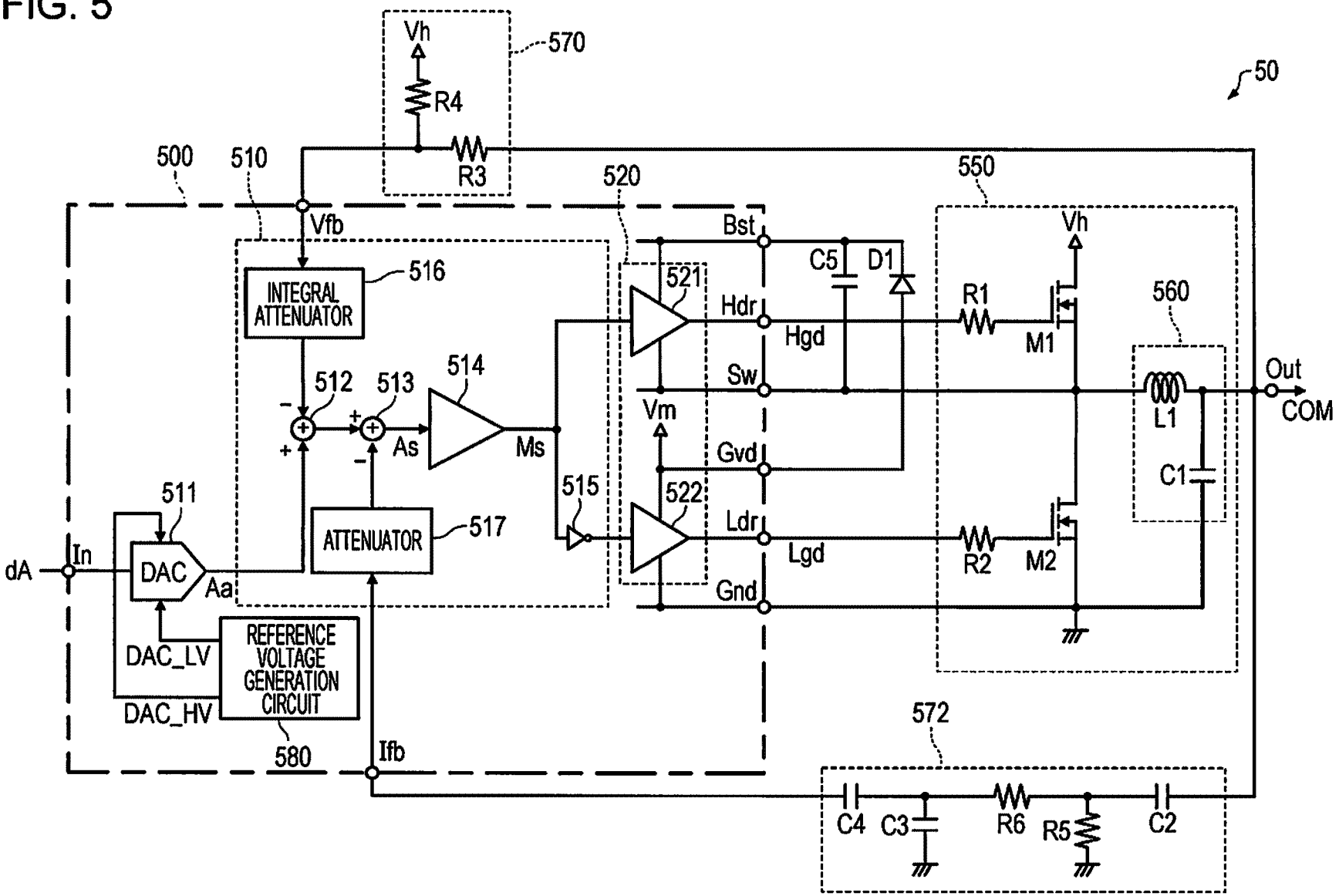
FIG. 5 is a diagram illustrating a circuit configuration of a drive circuit.

Next, the drive circuit 50 will be described in detail with reference to FIG. 5. FIG. 5 is a diagram illustrating a circuit configuration of the drive circuit 50. As illustrated in FIG. 5, the drive circuit 50 generates and outputs a drive signal COM for displacing a piezoelectric element 60 included in the head unit 20, based on data dA input from the control circuit 100.

The drive circuit 50 includes an integrated circuit 500, an output circuit 550, a first feedback circuit 570, a second feedback circuit 572, and a plurality of other circuit elements.

The integrated circuit 500 includes a digital to analog converter (DAC) 511, a modulation circuit 510, a gate driver 520, and a reference voltage generation circuit 580. In addition, the integrated circuit 500 is connected to the outside via a plurality of terminals including a terminal In, a terminal Bst, a terminal Hdr, a terminal Sw, a terminal Gvd, a terminal Ldr, a terminal Gnd, a terminal Vfb, and a terminal Ifb.

The integrated circuit 500 modulates the data dA that defines a waveform of the drive signal COM input from the terminal In, and generates and outputs a first amplification control signal Hgd and a second amplification control signal Lgd for driving gates of a first transistor M1 and a second transistor M2 included in the output circuit 550.

The reference voltage generation circuit 580 generates a first reference voltage DAC_HV and a second reference voltage DAC_LV, and supplies the signals to the DAC 511.

The DAC 511 converts the data dA into an original drive signal aA which is an analog signal of a voltage between the first reference voltage DAC_HV and the second reference voltage DAC_LV, and supplies the converted signal to an input terminal (+) of an adder 512 included in the modulation circuit 510.

The modulation circuit 510 includes the adder 512, an adder 513, a comparator 514, an inverter 515, an integral attenuator 516, and an attenuator 517.

The integral attenuator 516 attenuates and integrates a voltage of the drive signal COM input via the terminal Vfb, and supplies the attenuated and integrated voltage to an input terminal (−) of the adder 512.

The adder 512 subtracts a voltage which is output from the integral attenuator 516 and is input to the input terminal (−), from a voltage of the original drive signal aA input to the input terminal (+), and supplies the integrated voltage to the input terminal (+) of the adder 513.

Here, there is a case where a maximum voltage of the drive signal COM exceeds 40 V, whereas a maximum voltage of the original drive signal aA is approximately 2 V defined by the first reference voltage DAC_HV and the second reference voltage DAC_LV. Accordingly, the integral attenuator 516 attenuates the voltage of the drive signal COM in order to match amplitude ranges of both voltages when determining a deviation.

The attenuator 517 attenuates a high frequency component of the voltage of the drive signal COM input via the terminal Ifb and supplies the voltage to the input terminal (−) of the adder 513.

The adder 513 outputs a voltage signal As obtained by subtracting a voltage which is input to the input terminal (−) and is output from the attenuator 517, from a voltage which is input to the input terminal (+) and is output from the adder 512, to the comparator 514.

The voltage signal As output from the adder 513 is a voltage obtained by subtracting a voltage supplied to the terminal Vfb from a voltage of the original drive signal aA, and by further subtracting a voltage supplied to the terminal Ifb. That is, it can be said that the voltage signal As is a voltage signal obtained by correcting a deviation obtained by subtracting an attenuation voltage of the output drive signal COM from the voltage of the original drive signal aA which is a target, with a high frequency component of the drive signal COM.

The comparator 514 generates and outputs a modulation signal Ms, based on the input voltage signal As. Specifically, the comparator 514 generates the modulation signal Ms that goes to an H level when a voltage of the voltage signal As output from the adder 513 increases and in a case where the voltage of the voltage signal As increases to be higher than or equal to a threshold Vth1 which will be described below, and goes to an L level when the voltage of the voltage signal As output from the adder 513 decreases and in a case where the voltage of the voltage signal As decreases to be lower than or equal to a threshold Vth2 which will be described below. A relationship of threshold Vth1>threshold Vth2 is set.

Then, the comparator 514 outputs the generated modulation signal Ms to a first gate driver 521 included in the gate driver 520 which will be described below. In addition, the comparator 514 outputs the generated modulation signal Ms to a second gate driver 522 included in the gate driver 520 via the inverter 515. Thus, a signal supplied to the first gate driver 521 and a signal supplied to the second gate driver 522 have mutually exclusive logic levels.

Here, the fact that logic levels of the signals supplied to the first gate driver 521 and the second gate driver 522 are in an exclusive relationship means that timing is actually controlled so as not to simultaneously become an H level. That is, "exclusive" here includes a concept that the logic levels of the signals supplied to the first gate driver 521 and the second gate driver 522 do not simultaneously become the H level.

As described above, the modulation circuit 510 generates the modulation signal Ms, based on the original drive signal aA (data dA) and a voltage of the drive signal COM fed back via the terminal Vfb and outputs the modulation signal to the output circuit 550 via the gate driver 520.

Here, the modulation signal is the modulation signal Ms in the narrow sense, but if it is considered that pulse-modulation is made according to the original drive signal aA which is an analog signal based on the data dA which is a digital signal, a negative signal of the modulation signal Ms is also included in the modulation signal. That is, the modulation signal output from the modulation circuit 510 includes not only the above-described modulation signal Ms but also a signal obtained by inverting a logic level of the modulation signal Ms or timing-controlled signal.

In addition, a frequency and a duty ratio of the modulation signal Ms change according to the data dA (original drive signal aA). Accordingly, as the attenuator 517 adjusts a modulation gain (sensitivity), the amount of change in the frequency and the duty ratio can be adjusted.

The gate driver 520 includes the first gate driver 521 and the second gate driver 522.

The first gate driver 521 shifts a level of the modulation signal Ms output from the comparator 514 and outputs the modulation signal from the terminal Hdr as a first amplification control signal Hgd. Among power supply voltages of the first gate driver 521, a high-level side is a voltage supplied via the terminal Bst, and a low-level side is a voltage supplied via the terminal Sw. The terminal Bst is connected to one end of a capacitor C5 and a cathode electrode of a diode D1 for preventing a back flow. The terminal Sw is connected to the other end of the capacitor C5. An anode electrode of the diode D1 is connected to the terminal Gvd, and a voltage Vm from a power supply circuit (not illustrated) is supplied to the terminal Gbd. Thus, a potential difference between the terminal Bst and the terminal Sw is approximately equal to a potential difference between both ends of the capacitor C5, that is, the voltage Vm. Then, the first gate driver 521 generates the first amplification control signal Hgd having a voltage larger by the voltage Vm with respect to the terminal Sw, according to the input modulation signal Ms, and outputs the first amplification control signal from the terminal Hdr to the outside of the integrated circuit 500.

The second gate driver 522 operates at a lower potential side than the first gate driver 521. The second gate driver 522 shifts a level of a signal obtained by inverting the modulation signal Ms output from the comparator 514 by using the inverter 515, and outputs the inverted signal as the second amplification control signal Lgd from the terminal Ldr. Among power supply voltages of the second gate driver 522, a high-level side is supplied with the voltage Vm, and a low-level side is supplied with a ground potential (0 V) via the terminal Gnd. The second gate driver 522 outputs a voltage larger by the voltage Vm to the terminal Gnd as the second amplification control signal Lgd from the terminal Ldr, according to the inverted signal of the input modulation signal Ms.

The output circuit 550 includes a first transistor M1, a second transistor M2, and a low pass filter 560. The output circuit 550 generates the drive signal COM by amplifying and demodulating the input modulation signal Ms. It can be said that the drive signal COM is obtained by amplifying the original drive signal aA corresponding to the data dA, in other words, the data dA or the original drive signal aA is an original signal from which the drive signal COM is derived.

A voltage Vh is supplied to a drain of the first transistor M1. A gate of the first transistor M1 is connected to one end of a resistor R1, and the other end of the resistor R1 is connected to the terminal Hdr of the integrated circuit 500. Thus, the first amplification control signal Hgd is supplied to the gate of the first transistor M1. A source of the first transistor M1 is connected to the terminal Sw of the integrated circuit 500.

A drain of the second transistor M2 is connected to the source of the first transistor M1. A gate of the second transistor M2 is connected to one end of a resistor R2, and the other end of the resistor R2 is connected to the terminal Ldr of the integrated circuit 500. Thus, the second amplification control signal Lgd is supplied to the gate of the second transistor M2. A source of the second transistor M2 is connected to the ground potential.

In the first transistor M1 and the second transistor M2 connected as described above, when the first transistor M1 is turned off and the second transistor M2 is turned on, a voltage at a connection point to which the terminal Sw is connected becomes the ground potential, and the voltage Vm is applied to the terminal Bst. Meanwhile, when the first transistor M1 is turned on and the second transistor M2 is turned off, a voltage at a connection point to which the terminal Sw is connected becomes a voltage Vh, and a voltage Vh+Vm is applied to the terminal Bst. That is, the first gate driver 521 that drives the first transistor M1 uses the capacitor C5 as a floating power supply, and changes a potential of the terminal Sw to 0 V or the voltage Vh, according to operations of the first transistor M1 and the second transistor M2, thereby, outputting the first amplification control signal Hgd in which an L level is the voltage Vh and an H level is voltage Vh+voltage Vm to the gate of the first transistor M1. Then, the first transistor M1 performs a switching operation, based on the first amplification control signal Hgd.

Since a potential of the terminal Gnd is fixed to the ground potential regardless of an operation of the first transistor M1 and the second transistor M2, the second gate driver 522 that drives the second transistor M2 outputs the second amplification control signal Lgd whose L level is 0 V and whose H level is the voltage Vm. The second transistor M2 performs a switching operation, based on the second amplification control signal Lgd.

As described above, the first transistor M1 and the second transistor M2 perform the switching operation in response to the first amplification control signal Hgd and the second amplification control signal Lgd based on the modulation signal Ms. By the switching operation of the first transistor M1 and the second transistor M2, an amplification modulation signal in which the modulation signal Ms is amplified based on the voltage Vh is generated at a connection point to which the source of the first transistor M1 and the drain of the second transistor M2 are connected. That is, the first transistor M1 and the second transistor M2 function as an amplification circuit. At this time, since the first amplification control signal Hgd and the second amplification control signal Lgd for driving the first transistor M1 and the second transistor M2 are in an exclusive relationship as described above, the first transistor M1 and the second transistor M2 are controlled so as not to be simultaneously turned on.

The low pass filter 560 includes an inductor L1 and a capacitor C1.

One end of the inductor L1 is commonly connected to the source of the first transistor M1 and the drain of the second transistor M2, and the other end is connected to a terminal Out from which the drive signal COM is output. The terminal Out is also connected to one end of the capacitor C1, and the other end of the capacitor C1 is connected to the ground potential.

Thereby, the inductor L1 and the capacitor C1 smoothen and demodulate an amplification modulation signal supplied to a connection point between the first transistor M1 and the second transistor M2, thereby, generating the drive signal COM.

As described above, the drive signal COM is generated by smoothening the amplification modulation signal amplified based on the voltage Vh. That is, the voltage Vh is a signal having a voltage value larger than a voltage of the drive signal COM and corresponds to the "third voltage signal" described above.

The first feedback circuit 570 includes a resistor R3 and a resistor R4. One end of the resistor R3 is connected to the terminal Out, and the other end is connected to the terminal Vfb and one terminal of the resistor R4. The voltage Vh is applied to the other end of the resistor R4. Thereby, the drive signal COM passing through the first feedback circuit 570 from the terminal Out which is the output terminal of the drive circuit 50 is pulled up and is fed back to the terminal Vfb. That is, the first feedback circuit 570 corresponds to the "feedback circuit" described above.

The second feedback circuit 572 includes capacitors C2, C3, C4 and resistors R5 and R6.

One end of the capacitor C2 is connected to the terminal Out, and the other end is connected to one end of the resistor R5 and one end of the resistor R6. The other end of the resistor R5 is connected to the ground potential. Thereby, the capacitor C2 and the resistor R5 function as a high pass filter. A cutoff frequency of the high pass filter formed by the capacitor C2 and the resistor R5 is set to, for example, approximately 9 MHz. The other end of the resistor R6 is connected to one end of the capacitor C4 and one end of the capacitor C3. The other end of the capacitor C3 is grounded. Thereby, the resistor R6 and the capacitor C3 function as a low pass filter. A cutoff frequency of the low-pass filter formed by the resistor R6 and the capacitor C3 is set to approximately, for example, 160 MHz. By configuring the high pass filter and the low pass filter in this manner, the second feedback circuit 572 functions as a band pass filter through which a predetermined frequency range of the drive signal COM passes.

The other end of the capacitor C4 is connected to the terminal Ifb of the integrated circuit 500. Thereby, among the high frequency components of the drive signal COM passing through the second feedback circuit 572 functioning as the band pass filter, a direct current component is cut off and fed back to the terminal Ifb. However, the drive signal COM is a signal obtained by smoothening the amplification modulation signal using the low pass filter 560. The drive signal COM is integrated and subtracted through the terminal Vfb, and thereafter, is fed back to the adder 512. Thus, self-excited oscillation occurs at a frequency determined by a feedback delay and a feedback transfer function. However, there is a case where since the amount of delay of a feedback path via the terminal Vfb is large, it is sometimes impossible to increase a self-excited oscillation frequency such that accuracy of the drive signal COM can sufficiently be ensured only by feedback via the terminal Vfb. Therefore, by providing a path for feeding back a high frequency component of the drive signal COM via the terminal Ifb separately from the path via the terminal Vfb, it is possible to reduce the delay as viewed from the entire circuit. Thereby, a frequency of the voltage signal As increases as an accuracy of the drive signal COM can be sufficiently secured, as compared with a case where there is no path through the terminal Ifb.

Figure 6:
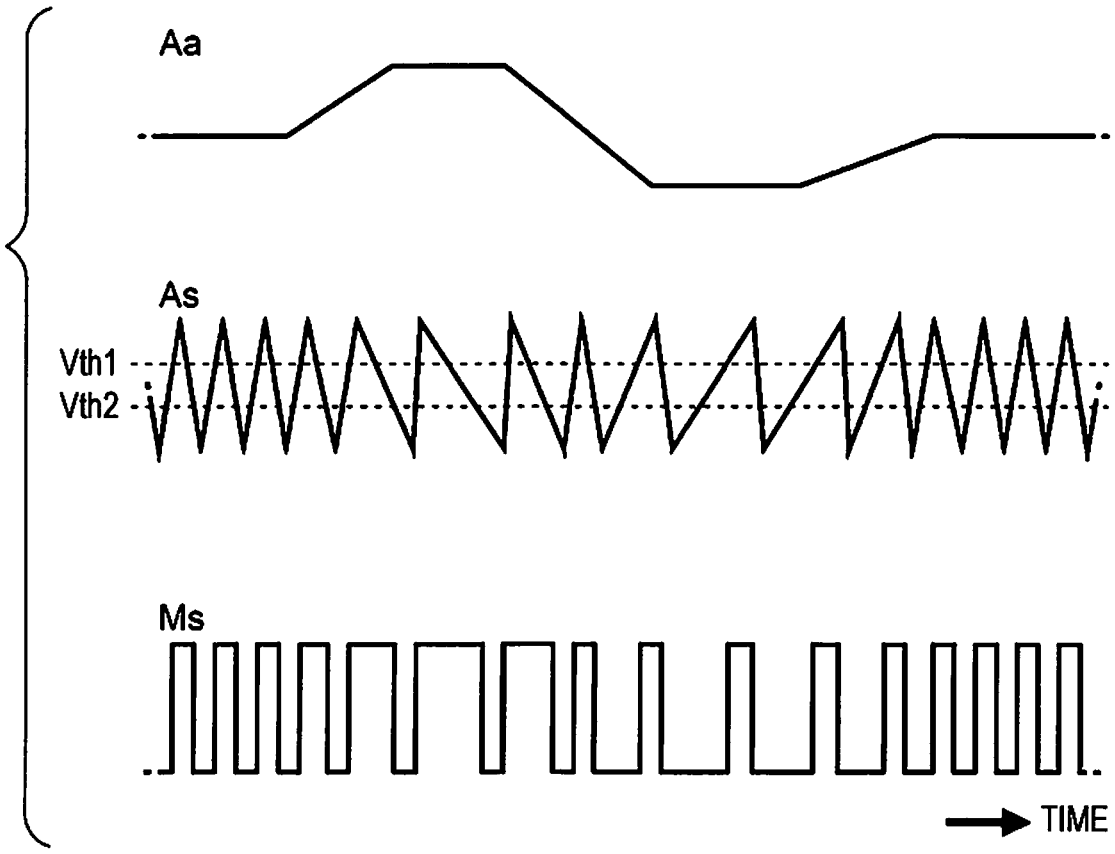
FIG. 6 is a diagram illustrating waveforms of a voltage signal and a modulation signal in association with waveform of an original drive signal.

FIG. 6 is a diagram illustrating waveforms of the voltage signal As and the modulation signal Ms in association with a waveform of the original drive signal aA.

As illustrated in FIG. 6, the voltage signal As is a triangular wave, and an oscillation frequency thereof varies according to a voltage of the original drive signal aA. Specifically, the voltage becomes the highest in a case where the voltage has an intermediate value, and the voltage decreases as the voltage increases or decreases from the intermediate value.

In addition, a slope of the triangular wave of the voltage signal As is substantially equal between a rise and a fall of the voltage if the voltage is near the intermediate value. Accordingly, a duty ratio of the modulation signal Ms obtained by comparing the voltage signal As with the thresholds Vth1 and Vth2 using the comparator 514 is approximately 50%. If the voltage of the voltage signal As increases from the intermediate value, a downward slope of the voltage signal As becomes gentle. Accordingly, a period during which the modulation signal Ms goes to an H level becomes relatively long, and a duty ratio of the modulation signal Ms increases. Meanwhile, if the voltage of the voltage signal As decreases from the intermediate value, an upward slope of the voltage signal As becomes gentle. Accordingly, the period during which the modulation signal Ms goes to an H level is relatively shortened, and the duty ratio of the modulation signal Ms decreases.

The first gate driver 521 turns on or off the first transistor M1, based on the modulation signal Ms. That is, the first gate driver 521 turns on the first transistor M1 if the modulation signal Ms is at an H level and turns off the first transistor M1 if the modulation signal Ms is at an L level. The second gate driver 522 turns on or off the second transistor M2, based on an inverted logic signal of the modulation signal Ms. That is, the second gate driver 522 turns off the second transistor M2 if the modulation signal Ms is at an H level and turns on the second transistor M2 if the modulation signal Ms is at an L level.

Thus, the voltage of the drive signal COM obtained by smoothening the amplification modulation signal using the inductor L1 and the capacitor C1 increases as the duty ratio of the modulation signal Ms increases, and decreases as the duty ratio decreases. Thus, the drive signal COM is controlled to be a signal obtained by increasing the voltage of the original drive signal aA obtained by converting the data dA into the analog signal. When the duty ratio of the modulation signal Ms is kept constant, the drive signal COM becomes a constant voltage signal.

Since the drive circuit 50 uses a pulse density modulation, there is an advantage that a change width of the duty ratio can be increased with respect to a pulse width modulation in which a modulation frequency is fixed.

The minimum positive pulse width and negative pulse width that can be used in the drive circuit 50 are restricted by circuit features thereof. Accordingly, in a frequency-fixed pulse width modulation, only a predetermined range can be secured as a change width of the duty ratio. In contrast to this, in the pulse density modulation, the oscillation frequency decreases as the voltage of the voltage signal As moves away from the intermediate value, and the duty ratio can be more increased in a region where the voltage is high, and the duty ratio can be more reduced in a region where the voltage is low. Thus, in a self-excited oscillation type pulse density modulation, a wider range can be secured as the change width of the duty ratio.

As described above, the drive circuit 50 outputs the drive signal COM from the terminal Out which is an output terminal, and the drive signal COM corresponds to the "first voltage signal" described above.

3. Configuration of Head Unit

Next, a configuration and an operation of the head unit 20 will be described.

First, a configuration of the ejection unit 600 provided in the recording head 21 will be described with reference to FIGS. 7 and 8. Next, an example of the drive signal COM and the reference voltage signal VBS which are supplied to the head unit 20 will be described with reference to FIGS. 9 and 10. The configuration and operation of the head unit 20 will be described below with reference to FIGS. 11 to 15.

Figure 7:
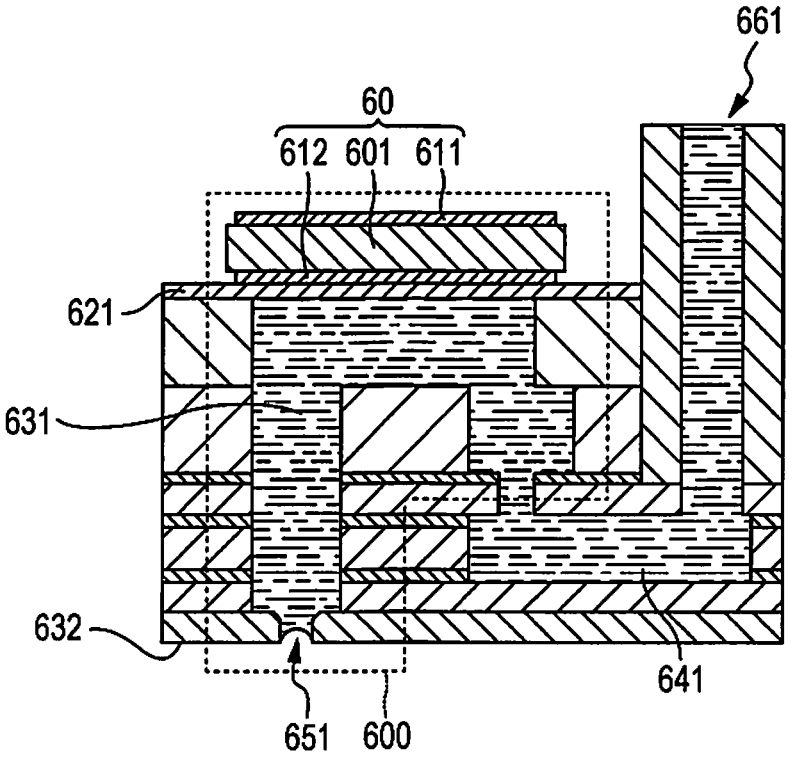
FIG. 7 is a sectional view illustrating a schematic configuration of an ejection unit.

FIG. 7 is a sectional view illustrating a schematic configuration of the ejection unit 600 by which the recording head 21 is cut so as to include the ejection unit 600. As illustrated in FIG. 7, the recording head 21 includes an ejection unit 600 and a reservoir 641.

The reservoir 641 is provided for each color of ink, and ink is introduced into the reservoir 641 from the supply hole 661.

The ejection unit 600 includes the piezoelectric element 60, a vibration plate 621, a cavity 631 (pressure chamber), and a nozzle 651. Among those, the vibration plate 621 is provided between the cavity 631 and the piezoelectric element 60, is displaced by the piezoelectric element 60 provided on an upper surface, and functions as a vibration plate that increases and reduces the internal volume of the cavity 631 filled with the ink. The nozzle 651 is provided in the nozzle plate 632 and is an opening portion communicating with the cavity 631. The cavity is filled with ink inside the cavity 631, and the internal volume thereof is changed by a displacement of the piezoelectric element 60. The nozzle 651 communicates with the cavity 631 and ejects the ink in the cavity 631 as ink droplets in accordance with a change in the internal volume of the cavity 631.

The piezoelectric element 60 illustrated in FIG. 7 has a structure in which a piezoelectric body 601 is interposed between a pair of the first electrodes 611 and the second electrodes 612. The drive signal VOUT is supplied to the first electrode 611 and the reference voltage signal VBS is supplied to the second electrode 612. In the piezoelectric element 60 having the structure, a central portion of the piezoelectric body 601 is displaced in the vertical direction with respect to both end portions together with the first electrode 611, the second electrode 612, and the vibration plate 621, according to a potential difference between the first electrode 611 and the second electrode 612, that is, a potential difference between the drive signal VOUT and the reference voltage signal VBS. Then, ink is ejected from the nozzle 651, according to the displacement of the piezoelectric element 60. Specifically, if the piezoelectric element is bent in the upward direction, the internal volume of the cavity 631 increases, and thereby, ink is drawn from the reservoir 641, whereas if the piezoelectric element is bent in the downward direction, the internal volume of the cavity 631 is reduced, and thereby, the ink is ejected from the nozzle 651 depending on the reduction of the internal volume. The reference voltage signal VBS supplied to the second electrode 612 of the piezoelectric element 60 corresponds to the "second voltage signal".

Figure 8:
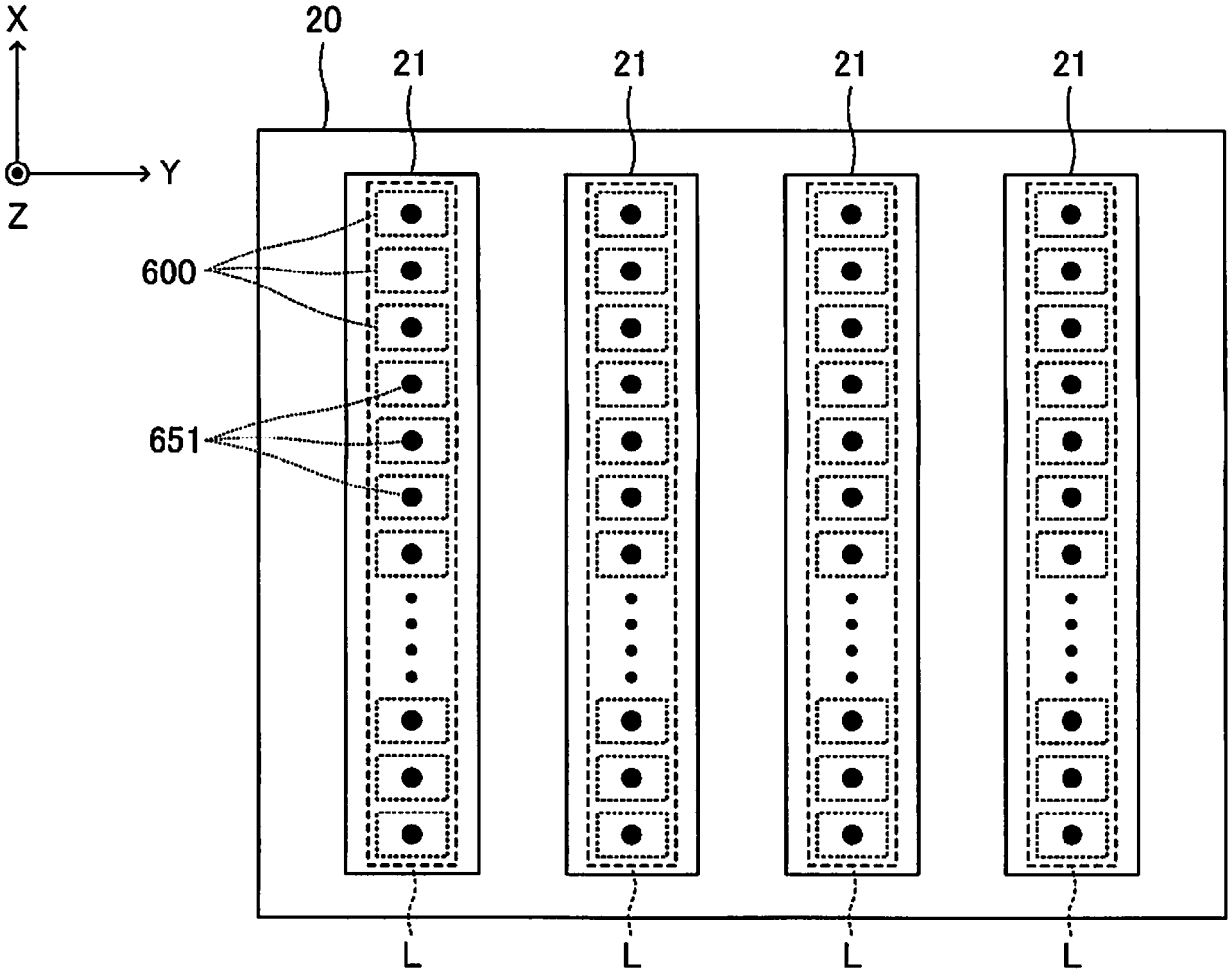
FIG. 8 is a diagram illustrating an example of arrangement of a plurality of nozzles provided in the recording head.

FIG. 8 is a view illustrating an example of the arrangement of the plurality of recording heads 21 included in the head unit 20 and the plurality of nozzles 651 provided in the recording head 21 in a plan view of the liquid ejecting apparatus 1 in the direction Z. In FIG. 8, description will be made by assuming that the head unit 20 includes four recording heads 21.

As illustrated in FIG. 8, in each recording head 21, a nozzle row L configured by the plurality of nozzles 651 arranged in a row in a predetermined direction is formed. In the present embodiment, each nozzle row L is formed by M nozzles 651 arranged in a row in the direction X.

The nozzle row L illustrated in FIG. 8 is an example and other configurations may be adopted. For example, in each nozzle row L, M nozzles 651 may be arranged in a staggered manner such that a location in the direction Y differs between the even-numbered nozzles 651 and the odd-numbered nozzles 651 which are counted from an end thereof. Each nozzle row L may be formed in a direction different from the direction X. In addition, in the present embodiment, the number of the nozzle rows L provided in each recording head 21 is exemplified as "1", but two or more nozzle rows L may be formed in each recording head 21.

Here, in the present embodiment, M nozzles 651 forming the nozzle row L are provided at a high density of 300 or more per inch in the recording head 21. Accordingly, in the recording head 21, M piezoelectric elements 60 are also provided at a high density corresponding to the M nozzles 651.

In the present embodiment, it is preferable that the piezoelectric body 601 used for the piezoelectric element 60 be a thin film having, for example, a thickness smaller than or equal to 1 μm. Thereby, the amount of displacement of the piezoelectric element 60 with respect to a potential difference between the first electrode 611 and the second electrode 612 can increase.

Here, the drive signal COM and the reference voltage signal VBS supplied to the piezoelectric element 60 will be described with reference to FIGS. 9 and 10.

Figure 9:
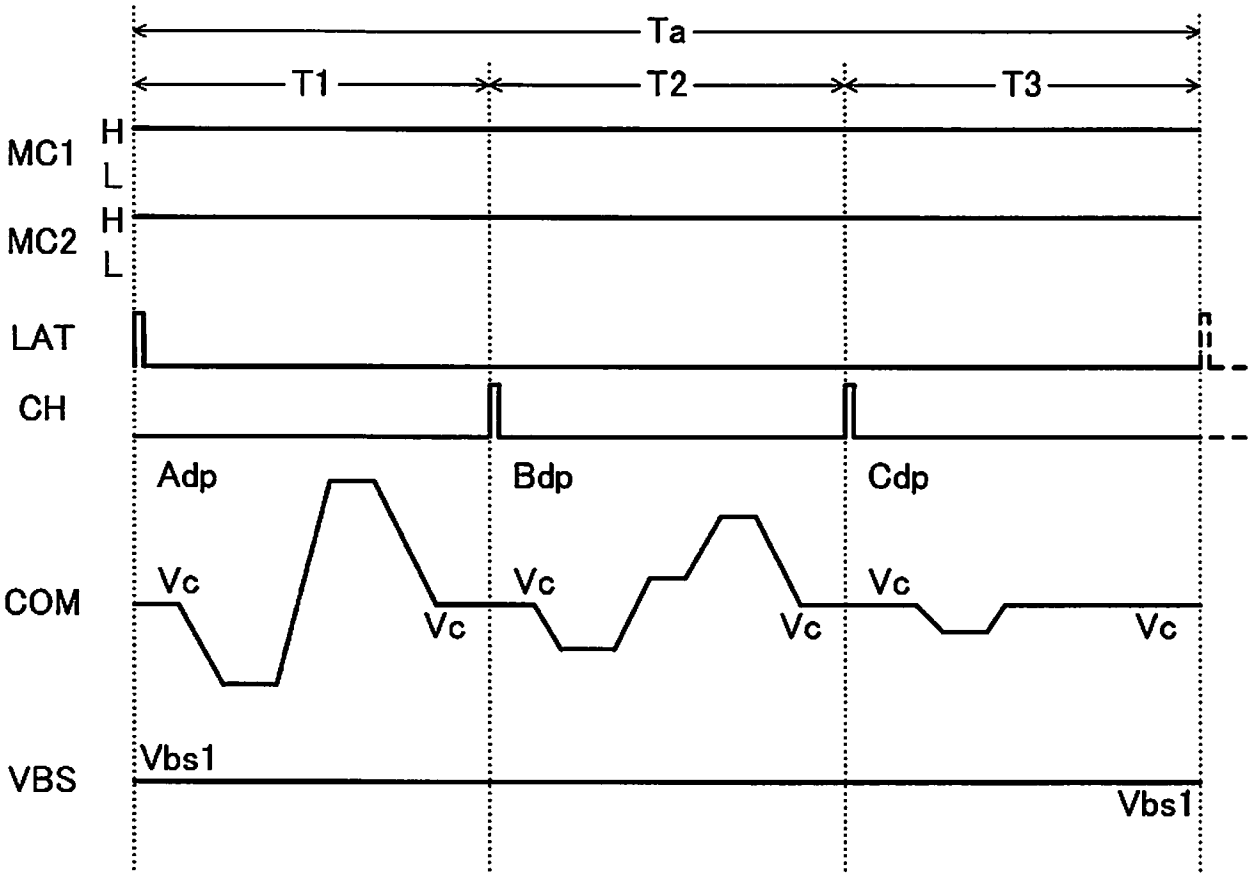
FIG. 9 is a diagram illustrating an example of a drive signal and a reference voltage signal in a print mode.

FIG. 9 is a diagram illustrating the drive signal COM and the reference voltage signal VBS in the print mode. FIG. 9 illustrates a period T1 between a rise of the latch signal LAT and a rise of the change signal CH, a period T2 between the period T1 and a point of time when the next change signal CH rises, and a period T3 between the period T2 and a point of time when the latch signal LAT rises. A period configured by the periods T1, T2, and T3 is a cycle Ta in which new dots are formed on the medium P.

As illustrated in FIG. 9, in the print mode in which the state signals MC1 and MC2 are both at an H level, the drive circuit 50 generates a voltage waveform Adp in the period T1. Then, by supplying the voltage waveform Adp to the first electrode 611, the piezoelectric element 60 is displaced such that the predetermined amount of ink, specifically, the medium amount of ink is ejected from the corresponding nozzle 651.

In addition, the drive circuit 50 generates a voltage waveform Bdp in the period T2. Then, by supplying the voltage waveform Bdp to the first electrode 611, the piezoelectric element 60 is displaced such that the small amount of ink smaller than the predetermined amount is ejected from the corresponding nozzle 651.

In addition, the drive circuit 50 generates a voltage waveform Cdp in the period T3. Then by supplying the voltage waveform Cdp to the first electrode 611, the piezoelectric element 60 is displaced such that ink droplets are not ejected from the corresponding nozzle 651. Thus, dots are not formed on the medium P. The voltage waveform Cdp is a waveform for slightly vibrating the ink near the opening of the nozzle 651 to prevent a viscosity of the ink from increasing. A state in which the piezoelectric element 60 is displaced to an extent that ink droplets are not ejected from the corresponding nozzle 651 is referred to as "minute vibration".

A voltage value at the start timing and a voltage value at the end timing of the voltage waveform Adp, the voltage waveform Bdp, and the voltage waveform Cdp are common as a voltage Vc. That is, the voltage waveform Adp, the voltage waveform Bdp, and the voltage waveform Cdp start at the voltage Vc and end at the voltage Vc.

Thus, in the print mode, the drive circuit 50 outputs the drive signal COM in which the voltage waveform Adp, the voltage waveform Bdp, and the voltage waveform Cdp are consecutive in the cycle Ta.

In the print mode, the voltage generation circuit 70 generates and outputs the reference voltage signal VBS whose voltage value is a voltage Vbs1 in the cycle Ta. The reference voltage signal VBS functions as a reference voltage for the displacement of the piezoelectric element 60.

In each cycle Ta of the print mode, the voltage waveform Adp is supplied to the first electrode 611 of the piezoelectric element 60 in the period T1 and the voltage waveform Bdp is supplied to the first electrode 611 in the period T2, and thereby, a medium amount of ink and a small amount of ink are ejected from the nozzle 651, and a "large dot" is formed on the medium P. In addition, the voltage waveform Adp is supplied to the first electrode 611 of the piezoelectric element 60 in the period T1 and the voltage waveform Bdp is not supplied to the first electrode 611 in the period T2, and thereby, the medium amount of ink is ejected from the nozzle 651, and a "medium dot" is formed on the medium P. In addition, the voltage waveform Adp is not supplied to the first electrode 611 of the piezoelectric element 60 in the period T1 and the voltage waveform Bdp is supplied to the first electrode 611 in the period T2, the small amount of ink is ejected from the nozzle 651, and a "small dot" is formed on the medium P. In addition, the voltage waveforms Adp and Bdp are not supplied to the first electrode 611 of the piezoelectric element 60 in the periods T1 and T2, and the voltage waveform Cdp is supplied to the first electrode 611 in the period T3, and thereby, ink is not ejected from the nozzle 651, and no dot is formed on the medium P.

Figure 10:
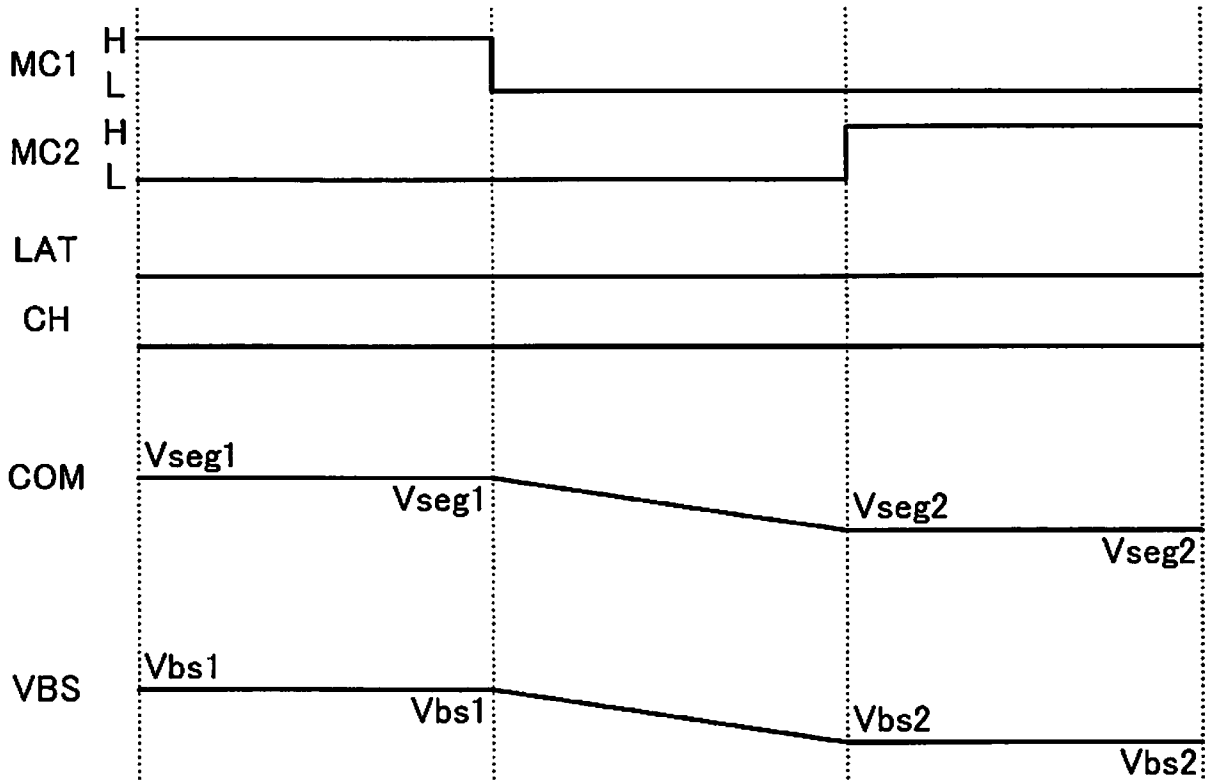
FIG. 10 is a diagram illustrating the drive signal and the reference voltage signal in a standby mode, a transition mode, and a sleep mode.

FIG. 10 is a diagram illustrating the drive signal COM and the reference voltage signal VBS in the standby mode, the transition mode, and the sleep mode. As illustrated in FIG. 10, in a case where the liquid ejecting apparatus 1 is in the standby mode, the transition mode, and the sleep mode, the latch signal LAT and the change signal CH are signals of an L level.

In the standby mode in which the state signal MC1 is at an H level and the state signal MC2 is at an L level, the drive circuit 50 generates and outputs the drive signal COM whose voltage value is the voltage Vseg1. In the standby mode, the voltage generation circuit 70 generates and outputs the reference voltage signal VBS whose voltage value is the voltage Vbs1.

In the sleep mode in which the state signal MC1 is at an L level and the state signal MC2 is at an H level, the drive circuit 50 generates and outputs the drive signal COM whose voltage value is the voltage Vseg2. In the sleep mode, the voltage generation circuit 70 generates and outputs the reference voltage signal VBS whose voltage value is the voltage Vbs2.

In the transition mode in which the state signal MC1 and the state signal MC2 are both at an L level, the drive circuit 50 generates and outputs the drive signal COM whose voltage value changes from the voltage Vseg1 to the voltage Vseg2. In the transition mode, the voltage generation circuit 70 generates and outputs the reference voltage signal VBS whose voltage value changes from the voltage Vbs1 to the voltage Vbs2.

Here, as will be described in detail below, in the standby mode, the transition mode, and the sleep mode, the voltage value of the drive signal COM is controlled to approximate the voltage value of the reference voltage signal VBS. That is, a potential difference between the first electrode 611 and the second electrode 612 of the piezoelectric element 60 is controlled so as to be small. Therefore, in the standby mode, the transition mode, and the sleep mode, a displacement of the piezoelectric element 60 is small, and the ink is not ejected from the nozzle 651.

Figure 11:
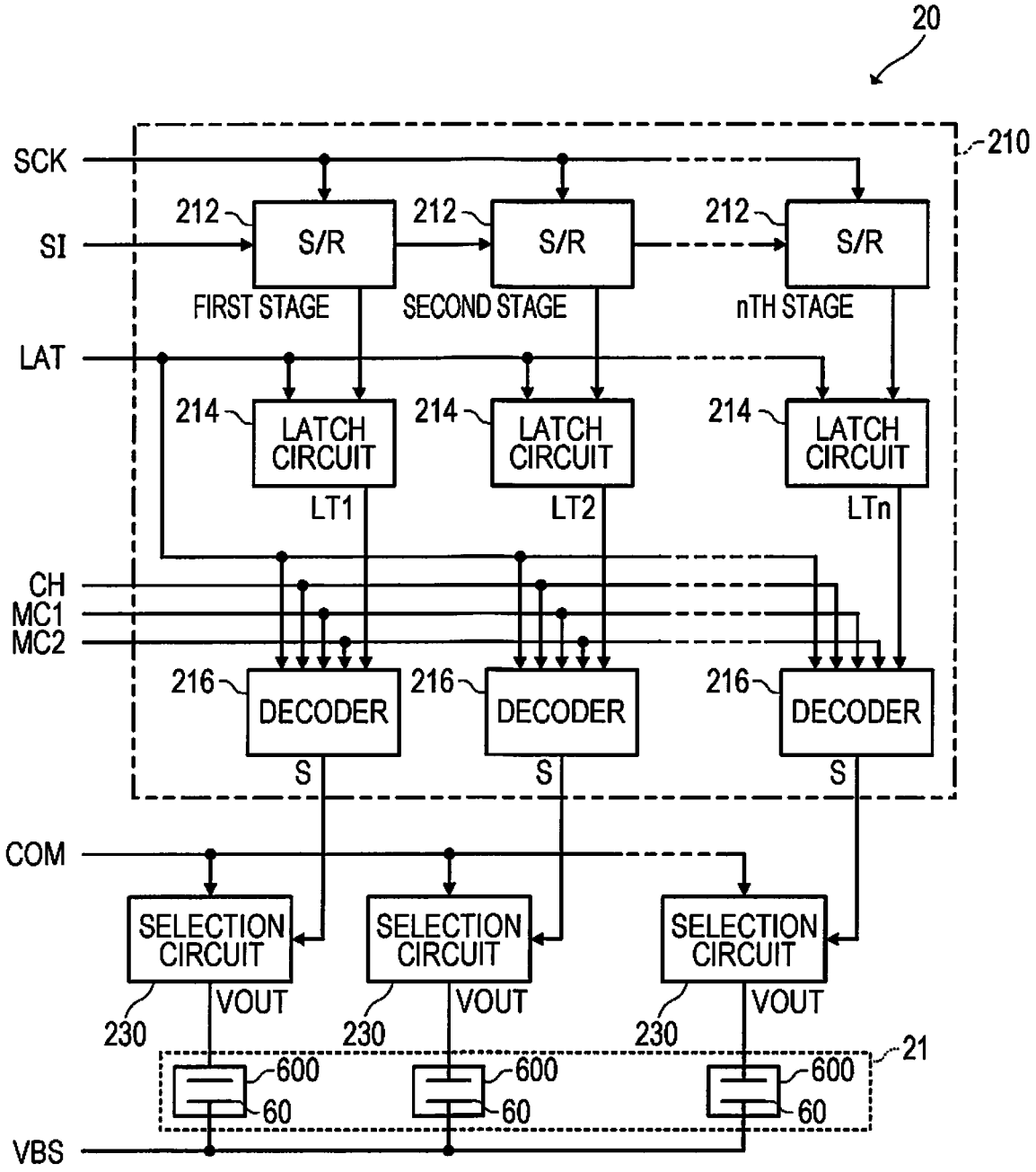
FIG. 11 is a diagram illustrating an electrical configuration of a head unit.

FIG. 11 is a diagram illustrating an electrical configuration of the head unit 20. As illustrated in FIG. 11, the head unit 20 includes the selection control circuit 210, the plurality of selection circuits 230, and the recording head 21.

The selection control circuit 210 receives the clock signal SCK, the print data signal SI, the state signals MC1 and MC2, the latch signal LAT, and the change signal CH. Te selection control circuit 210 includes a set of a shift register 212 (S/R), a latch circuit 214, and a decoder 216 corresponding to each of the ejection units 600. That is, the number of sets of the shift register 212, the latch circuit 214, and the decoder 216 included in the head unit 20 is the same as the total number n of the ejection units 600 included in the head unit 20.

The shift register 212 is configured to temporarily hold print data [SIH, SIL] of two bits included in the print data signal SI for each corresponding ejection unit 600.

In detail, the shift register 212 having the number of stages corresponding to the ejection units 600 is connected in cascade, and the serially supplied print data signal SI is sequentially transmitted to a subsequent stage in accordance with the clock signal SCK. In FIG. 11, in order to distinguish the shift register 212, it is denoted as a first stage, a second stage, . . . , an nth stage sequentially from an upstream side to which the print data signal SI is supplied.

Each of the n latch circuits 214 latches the print data [SIH, SIL] held by each of the n shift registers 212 at a leading edge of the latch signal LAT.

Each of the n decoders 216 decodes the print data [SIH, SIL] of two bits latched by each of the n latch circuits 214 and the state signals MC1 and MC2 to generate a selection signal S, and outputs the generated selection signal to the selection circuit 230.

The selection circuit 230 is provided corresponding to each of the ejection units 600. That is, the number of selection circuits 230 included in one head unit 20 is the same as the total number n of nozzles 651 included in the head unit 20. The selection circuit 230 selects the drive signal COM, based on the input selection signal S.

Figure 12:
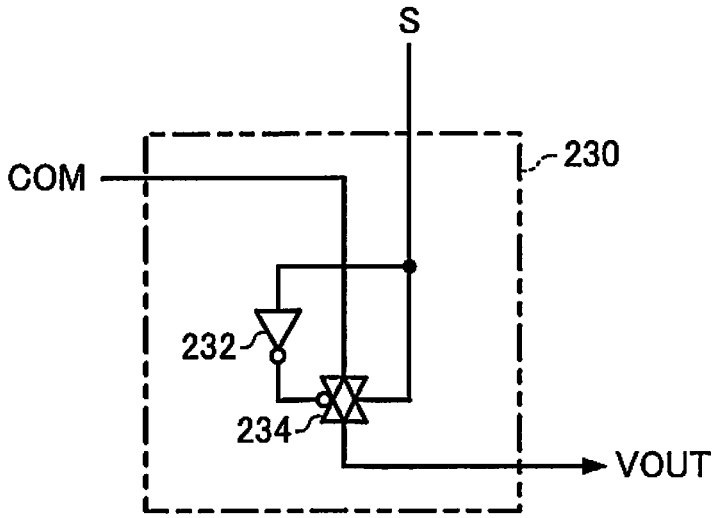
FIG. 12 is a diagram illustrating a configuration of a selection circuit.

FIG. 12 is a diagram illustrating a configuration of the selection circuit 230 corresponding to one ejection unit 600.

As illustrated in FIG. 12, the selection circuit 230 includes an inverter 232 (NOT circuit) and a transfer gate 234 which is a first switch element.

The selection signal S output from the decoder 216 is supplied to a positive control terminal which is not marked with a circle at the transfer gate 234. The selection signal S is logically inverted by the inverter 232 and is also supplied to a negative control terminal which is marked with a circle in the transfer gate 234.

The transfer gate 234 is electrically connected to the terminal Out of the drive circuit 50 and the first electrode 611 of the piezoelectric element 60, the drive signal COM is supplied to an input terminal thereof, and a voltage signal generated in an output terminal thereof is supplied to the ejection unit 600 as the drive signal VOUT.

If the selection signal S is at an H level, the transfer gate 234 connects (on) an input terminal thereof to an output terminal thereof, and if the selection signal S is at an L level, the transfer gate 234 does not connect (off) the input terminal to the output terminal.

Here, the decoding content of the decoder 216 according to the present embodiment will be described with reference to FIG. 13. FIG. 13 is a diagram illustrating the decoded content of the decoder 216.

The print data [SIH, SIL] of two bits, the state signals MC1 and MC2, the latch signal LAT, and the change signal CH output from the latch circuit 214 are input to the decoder 216.

In a case of the print mode in which both the state signals MC1 and MC2 are at an H level, the decoder 216 outputs the selection signal S of a logic level based on the print data [SIH, SIL] in each of the periods T1, T2, and T3 defined by the latch signal LAT and the change signal CH.

Specifically, in a case where the print data [SIH, SIL] is [1, 1] defining a "large dot", the decoder 216 outputs the selection signal S which goes to an H level in the period T1, does to an H level in the period T2, and goes to an L level in the period T3.

In a case where the print data [SIH, SIL] is [1, 0] defining a "medium dot", the decoder 216 outputs the selection signal S which goes to an H level in the period T1, goes to an L level in the period T2, and goes to an L level in the period T3.

In a case where the print data [SIH, SIL] is [0, 1] defining a "small dot", the decoder 216 outputs the selection signal S which goes to an L level in the period T1, goes to an H level in the period T2, and goes to an L level in the period T3.

In a case where the print data [SIH, SIL] is [0, 0] defining a "minute vibration", the decoder 216 outputs the selection signal S which goes to an L level in the period T1, goes to an L level in the period T2, and goes to an H level in the period T3.

In addition, the decoder 216 determines a logic level of the selection signal S regardless of the print data [SIH, SIL] and the periods T1, T2, and T3 in the standby mode, the transition mode, and the sleep mode.

Specifically, in a case of the standby mode in which the state signal MC1 is in an H and the state signal MC2 is in an L level, the decoder 216 outputs the selection signal S of an H level.

In a case of the transition mode in which the state signals MC1 is in an L level and the state signals MC2 is in an L level, the decoder 216 outputs the selection signal S of an H level.

In a case of the sleep mode in which the state signals MC1 is in an L and the state signals MC2 is in an H level, the decoder 216 outputs the selection signal S of an L level.

In the head unit 20 described above, an operation in which the drive signal VOUT is supplied to the ejection unit 600 will be described with reference to FIGS. 14 and 15.

Figure 14:
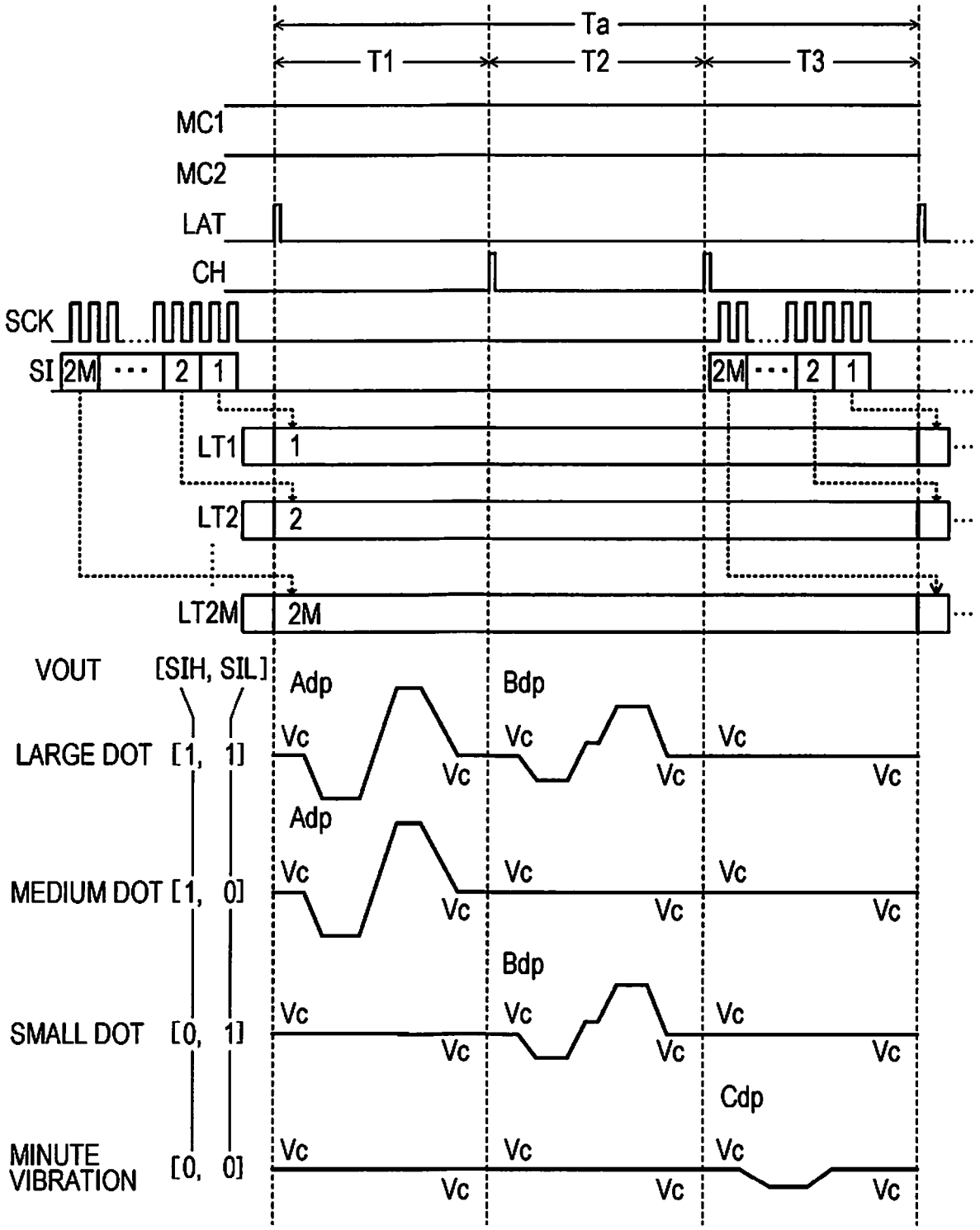
FIG. 14 is a diagram illustrating an operation of the head unit in the print mode.

FIG. 14 is a diagram illustrating the operation of the head unit 20 in the print mode.

In the print mode, the print data signal SI is serially supplied in synchronization with the clock signal SCK, and is sequentially transmitted to the shift registers 212 corresponding to the nozzles 651. If supplying the clock signal SCK is stopped, the print data [SIH, SIL] corresponding to the nozzles 651 is held in each of the shift registers 212. The print data signal SI is supplied to the shift registers in the order of the last nth stage, . . . , the second stage, and the first stage of the shift registers 212 corresponding to the nozzles 651.

Here, if the latch signal LAT rises, each of the latch circuits 214 latches the print data [SIH, SIL] held in the corresponding shift register 212 all at once. In FIG. 14, LT1, LT2, LTn indicate print data [SIH, SIL] latched by the latch circuit 214 corresponding to the shift registers 212 of the first stage, the second stage, . . . , the nth stage.

The decoder 216 outputs the selection signals S of the logic levels according to the content illustrated in FIG. 13, in each of the periods T1, T2, and T3, depending on a size of the dot defined by the latched print data [SIH, SIL].

In a case where the print data [SIH, SIL] is [1, 1], the selection circuit 230 selects the voltage waveform Adp in the period T1, selects the voltage waveform Bdp in the period T2, and does not select the voltage waveform Cdp in the period T3, according to the selection signal S. As a result, the drive signal VOUT corresponding to the large dot illustrated in FIG. 14 is supplied to the ejection unit 600.

In a case where the print data [SIH, SIL] is [1, 0], the selection circuit 230 selects the voltage waveform Adp in the period T1, does not select the voltage waveform Bdp in the period T2, and does not select the voltage waveform Cdp in the period T3, according to the selection signals S. As a result, the drive signal VOUT corresponding to the medium dot illustrated in FIG. 14 is supplied to the ejection unit 600.

In a case where the print data [SIH, SIL] is [0, 1], the selection circuit 230 does not select the voltage waveform Adp in the period T1, selects the voltage waveform Bdp in the period T2, and does not select the voltage waveform Cdp in the period T3, according to the selection signals S. As a result, the drive signal VOUT corresponding to the small dot illustrated in FIG. 14 is supplied to the ejection unit 600.

In a case where the print data [SIH, SIL] is [0, 0], the selection circuit 230 does not select the voltage waveform Adp in the period T1, does not select the voltage waveform Bdp in the period T2, and selects the voltage waveform Cdp in the period T3, according to the selection signals S. As a result, the drive signal VOUT corresponding to the minute vibration illustrated in FIG. 14 is supplied to the ejection unit 600.

Figure 15:
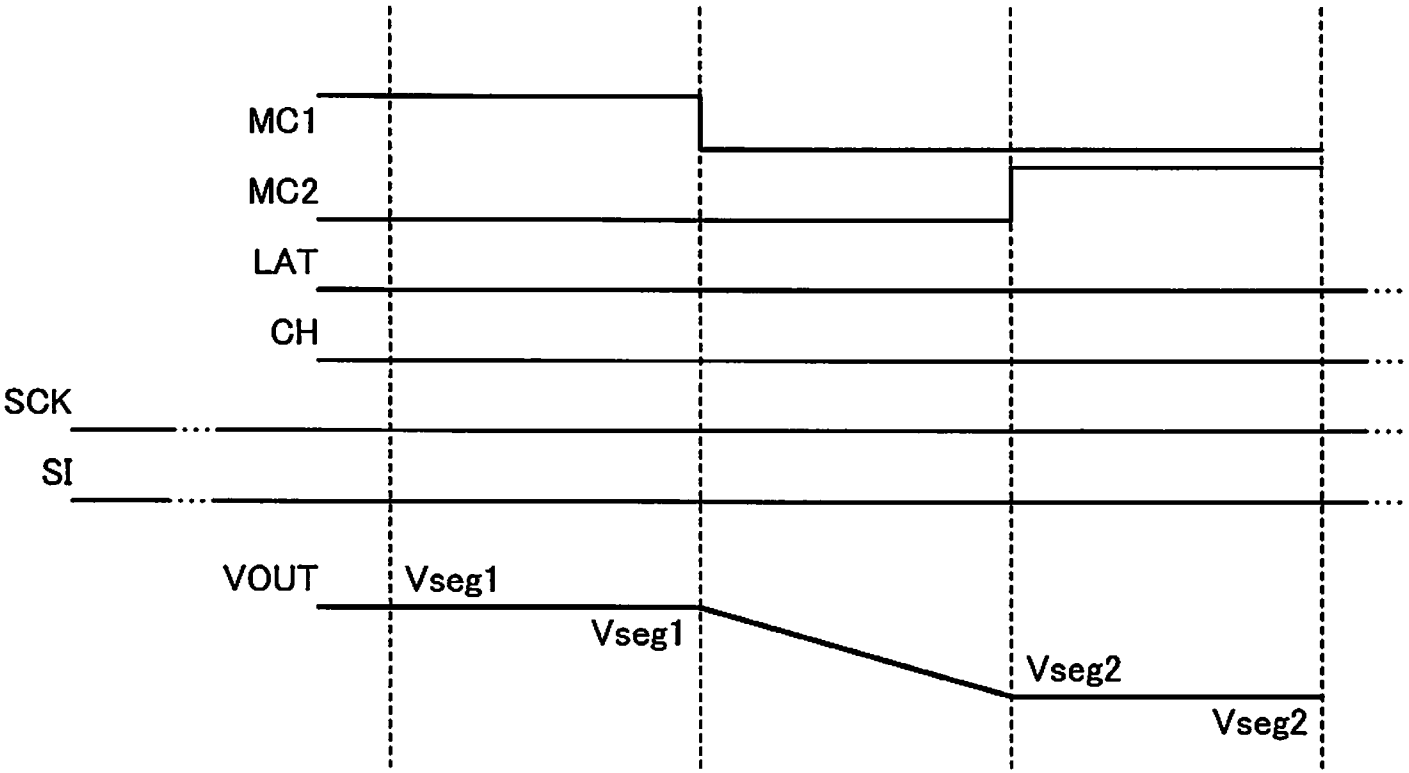
FIG. 15 is a view illustrating the operation of the head unit in the standby mode, the transition mode, and the sleep mode.

FIG. 15 is a diagram illustrating operations of the head unit 20 in the standby mode, the transition mode, and the sleep mode.

Since no printing is performed in the standby mode, the transition mode, and the sleep mode, in the present embodiment, the latch signal LAT, the change signal CH, the clock signal SCK, and the print data signal SI are all signals of an L level. Thus, the shift register 212 and the latch circuit 214 do not operate.

As described above, the decoder 216 determines a logic level of the selection signal S in response to the state signals MC1 and MC2.

In the standby mode in which the state signals MC1 and MC2 are at an H level and an L level, respectively, the selection circuit 230 selects the drive signal COM whose voltage value is the voltage Vseg1 in response to the selection signal S of an H level. As a result, the drive signal VOUT whose voltage value is the voltage Vseg1 as illustrating in FIG. 15 is supplied to the ejection unit 600.

In the transition mode in which the state signals MC1 and MC2 are both at an L level, the selection circuit 230 selects the drive signal COM whose voltage value changes from the voltage Vseg1 to the voltage Vseg2 in response to the selection signal S of an H level. As a result, the drive signal VOUT whose voltage value changes from the voltage Vseg1 to the voltage Vseg2 as illustrated in FIG. 15 is supplied to the ejection unit 600.

In the sleep mode in which the state signals MC1 and MC2 are at an L level and an H level, respectively, the selection circuit 230 does not select the drive signal COM whose voltage value is the voltage Vseg2 in response to the selection signal S of an L level. As a result, the drive signal VOUT holds the voltage value immediately before entering the sleep mode from the transition mode, that is, the voltage Vseg2.

4. Increase in Voltage Supplied to Piezoelectric Element Due to Leakage Current In the liquid ejecting apparatus 1 described above, the transfer gate 234 included in the selection circuit 230 is controlled to be turned off in the sleep mode.

Accordingly, ideally, a voltage and a current supplied to the first electrode 611 of the piezoelectric element 60 are cut off by the transfer gate 234 in the sleep mode. The voltage supplied to the first electrode 611 of the piezoelectric element 60 is held at a voltage value immediately before the transfer gate 234 is controlled to be turned off. Thus, immediately before the transfer gate 234 is controlled to be turned off, by controlling the voltage value of the first electrode 611 to approximate the voltage value of the reference voltage signal VBS supplied to the second electrode 612, it is possible to reduce holding of the piezoelectric element 60 in a displaced state in the sleep mode.

However, since the transfer gate 234 and the piezoelectric element 60 have resistance components, even in a case where the transfer gate 234 is controlled to be turned off, a leakage current flows through a resistance component of the transfer gate 234 and a resistance component of the piezoelectric element 60. Then, due to the leakage current, electric charges are accumulated in the piezoelectric element 60, a voltage of the first electrode 611 increases, and the piezoelectric element 60 may be largely displaced.

Figure 16:
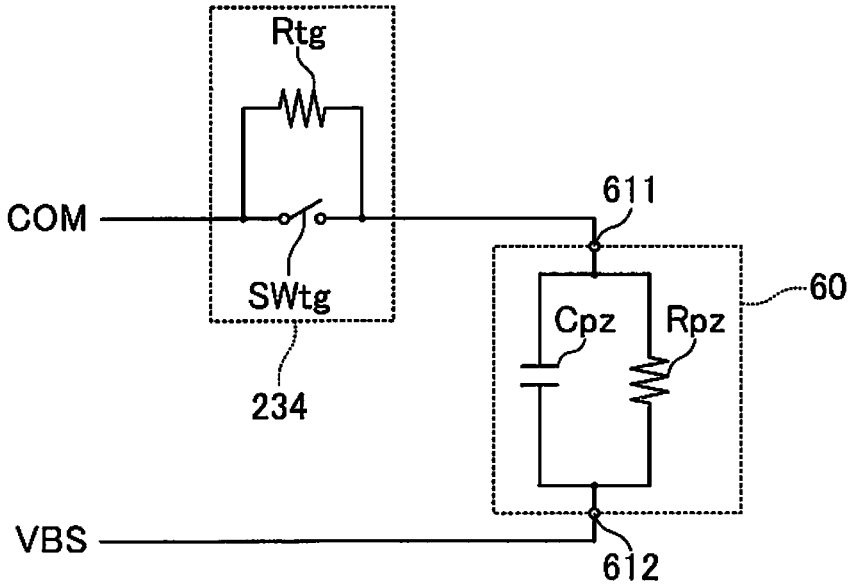
FIG. 16 is a diagram illustrating an equivalent circuit of a transfer gate and a piezoelectric element in a path through which the drive signal and the reference voltage signal are supplied to the piezoelectric element.

Here, the voltage supplied to the first electrode 611 of the piezoelectric element 60 due to the leakage current will be described with reference to FIGS. 16 and 17. FIG. 16 is a diagram illustrating an equivalent circuit of the transfer gate 234 and the piezoelectric element 60 in a path through which the drive signal COM and the reference voltage signal VBS are supplied to the piezoelectric element 60.

As illustrating in FIG. 16, the equivalent circuit of the transfer gate 234 includes a switch circuit SWtg and a resistance component Rtg which is parasitic in parallel with the switch circuit SWtg. The equivalent circuit of the piezoelectric element 60 includes a capacitance component Cpz and a resistance component Rpz which is parasitic in parallel with the capacitance component Cpz.

Figure 17:
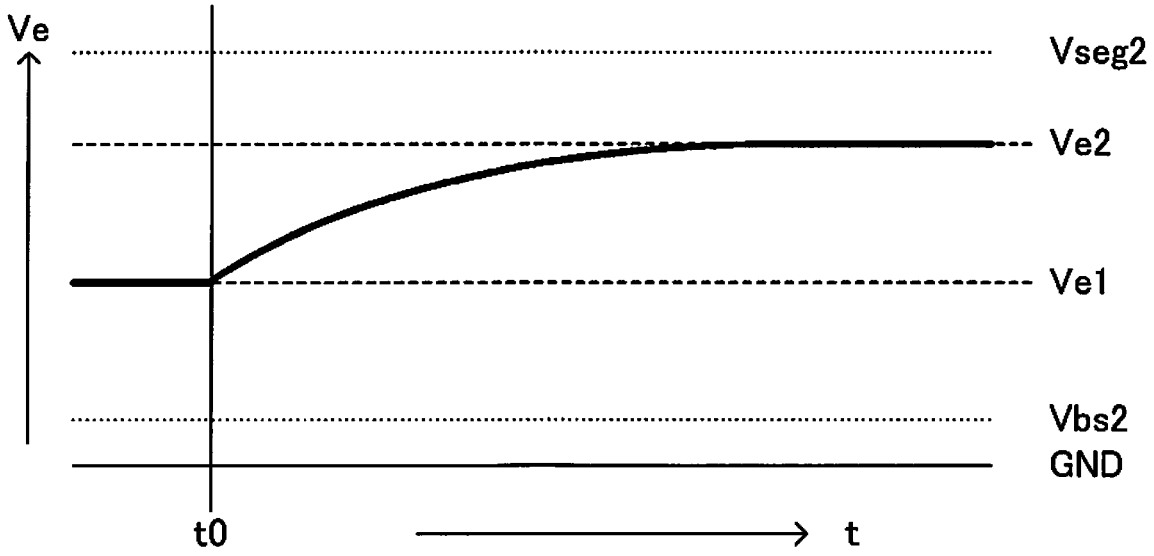
FIG. 17 is a diagram illustrating an example of a voltage of a first electrode of the piezoelectric element in the configuration illustrated in FIG. 16.

FIG. 17 is a diagram illustrating an example of the voltage of the first electrode 611 of the piezoelectric element 60 in the configuration illustrated in FIG. 16. In FIG. 17, a horizontal axis denotes time and a vertical axis denotes the voltage of the first electrode 611.

As illustrated in FIG. 17, the voltage value of the first electrode 611 when the mode is shifted to the sleep mode at time t0 and the switch circuit SWtg is controlled to be turned off is referred to as a voltage Ve1. Thereafter, the voltage of the first electrode 611 increases due to the leakage current flowing through the resistance component Rtg and the resistance component Rpz. In this state, in a case where a certain period of time elapses, the voltage value of the first electrode 611 becomes a voltage Ve2. The voltage Ve2 is represented by Equation (1).

$$Ve2 = Vbs2\frac{Rpz}{Rpz + Rtg}(Vseg2 - Vbs2) \tag{1}$$

Thereby, a potential difference Vdiff between the first electrode 611 and the second electrode 612 is represented by Equation (2).

$$Vdiff = \frac{Rpz}{Rpz + Rtg}(Vseg2 - Vbs2) \tag{2}$$

Here, in a case where the voltage value of the first electrode 611 changes from the voltage Ve1 to the voltage Ve2, a displacement of the piezoelectric element 60 and bending of the vibration plate 621 will be described with reference to FIGS. 18A and 18B.

Figure 18A:
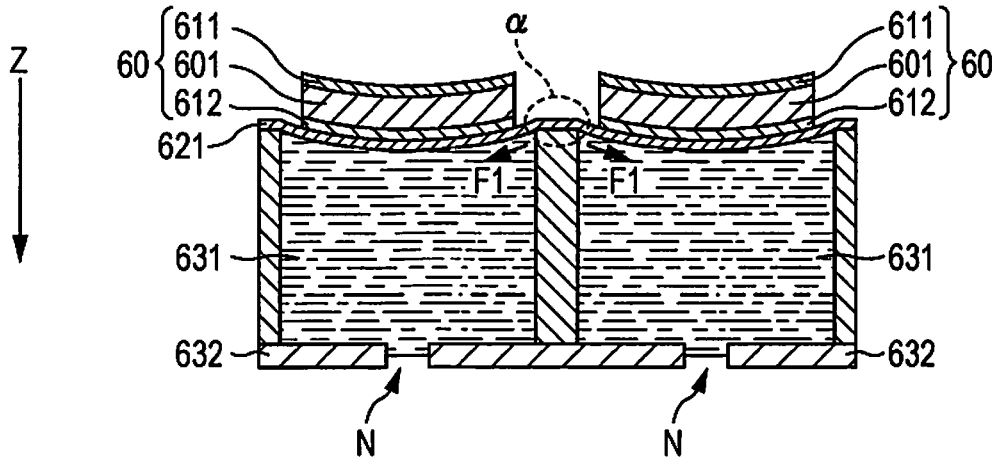
FIGS. 18A and 18B are diagrams schematically illustrating a displacement of the piezoelectric element and bending of a vibration plate.
Figure 18B:
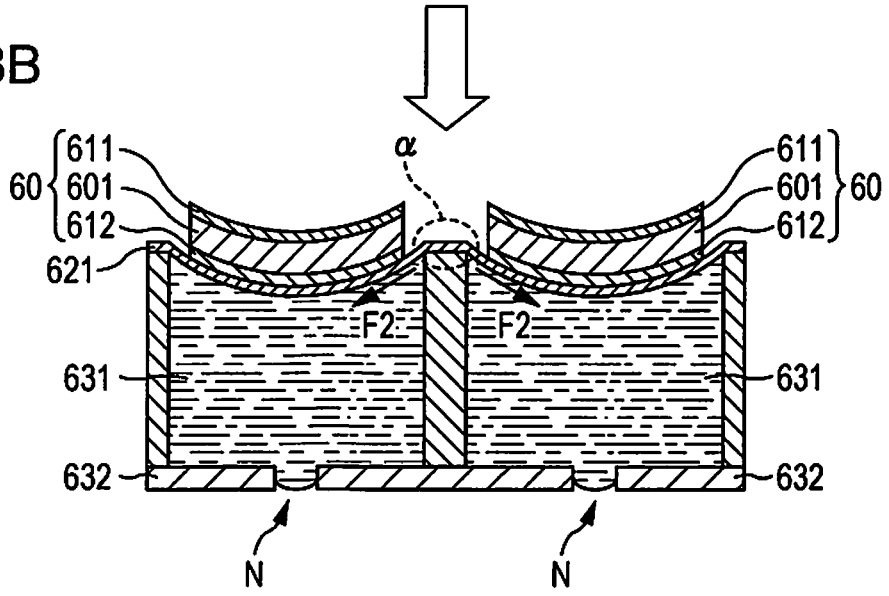

FIGS. 18A and 18B are diagrams schematically illustrating the displacement of the piezoelectric element 60 and bending of the vibration plate 621 in a case where a voltage supplied to the first electrode 611 changes from the voltage Ve1 to the voltage Ve2. FIG. 18A illustrates the displacement of the piezoelectric element 60 and the bending of the vibration plate 621 in a case where the voltage Ve1 is supplied to the first electrode 611, and FIG. 18B illustrates the displacement of the piezoelectric element 60 and the bending of the vibration plate 621 in a case where the voltage Ve2 larger than Ve1 is supplied to the first electrode 611.

As illustrated in FIG. 18A, the piezoelectric element 60 is displaced based on a potential difference between the voltage Ve1 and the voltage Vbs2 at time t0. At this time, the vibration plate 621 bends with the displacement of the piezoelectric element 60. The voltage Ve1 is a voltage immediately before being shifted to the sleep mode. That is, the voltage Ve1 is a voltage value assumed to be held by the first electrode 611 in the sleep state.

Thus, the piezoelectric element 60 is held with the assumed displacement, and the vibration plate 621 is bent with an assumed magnitude. At this time, an assumed stress F1 occurs in a contact point a between the vibration plate 621 and the cavity 631.

FIG. 18A illustrates that the voltage Ve1 and the voltage Vbs2 are different voltage values, but the voltage values may be equal. In this case, in FIG. 18A, the displacement of the piezoelectric element 60 and the bending of the vibration plate 621 do not occur.

Then, the piezoelectric element 60 is displaced based on the potential difference between the voltage Ve2 larger than the voltage Ve1 caused by a leakage current and the voltage Vbs2. At this time, the amount of bending of the vibration plate 621 changes based on the displacement of the piezoelectric element 60.

As a result, as illustrated in FIG. 18B, the displacement of the piezoelectric element 60 increases more than expected, and the bending occurring in the vibration plate 621 also increases more than expected. Thus, a stress F2 greater than expected occurs in the contact point a between the vibration plate 621 and the cavity 631.

The sleep mode may continue for a long time with respect to the print mode. Accordingly, a larger stress F2 than expected is continuously applied to the vibration plate 621 for a long time. Furthermore, in a case where the sleep state is shifted to the print state in a state where larger bending than expected is generated in the vibration plate 621, a load greater than necessary is applied to the vibration plate 621 when ink is ejected. As a result, a crack may be generated in the vibration plate 621.

As represented by Equation (1) and Equation (2), the voltage Ve2 and the potential difference Vdiff increase with an increase in the resistance component Rpz.

As described above, in the present embodiment, the nozzles 651 are provided with a high density of 300 or more per inch in the recording head 21, and the piezoelectric element 60 is also provided with a high density.

Accordingly, areas of the first electrode 611 and the second electrode 612 of the piezoelectric element 60 are reduced, and a valid area of a path through which the leakage current flows is also reduced, and thereby, the resistance component Rpz increases.

Thus, an increase in the voltage value of the first electrode 611 of the piezoelectric element 60 is more remarkable. Accordingly, the piezoelectric element 60 is largely displaced, and a large stress is applied to the piezoelectric element 60 and the vibration plate 621 for a long period of time, and thereby, a crack may be generated in the piezoelectric element 60 and the vibration plate 621.

If the crack occurs in the vibration plate 621, the ink filled in the cavity 631 leaks due to the crack. Accordingly, fluctuation may occur in the ejection amount of the ink with respect to a change in the internal volume of the cavity 631. As a result, accuracy of the ink ejection is reduced.

Furthermore, in a case where the ink leaked from the crack adheres to both the first electrode 611 and the second electrode 612, a current flows through the ink between the first electrode 611 and the second electrode 612. Accordingly, the voltage value of the reference voltage signal VBS supplied to the second electrode 612 varies. In the liquid ejecting apparatus 1 according to the present embodiment, the reference voltage signal VBS is commonly supplied to the plurality of piezoelectric elements 60. Accordingly, the variation of the voltage value of the reference voltage signal VBS affects the displacement of each of the plurality of piezoelectric elements 60, and as a result, the ejection accuracy of the entire liquid ejecting apparatus 1 may be affected.

5. Operation of Liquid Ejecting Apparatus in Standby Mode, Transition Mode, and Sleep Mode With respect to the problem described above, the liquid ejecting apparatus 1 according to the present embodiment is controlled such that the voltage value of the drive signal COM approximates the voltage value of the reference voltage signal VBS in the sleep mode in which the transfer gate 234 is controlled to be turned off.

Here, operations of the liquid ejecting apparatus 1 in the standby mode, the transition mode, and the sleep mode will be specifically described with reference to FIGS. 19 and 20.

Figure 19:
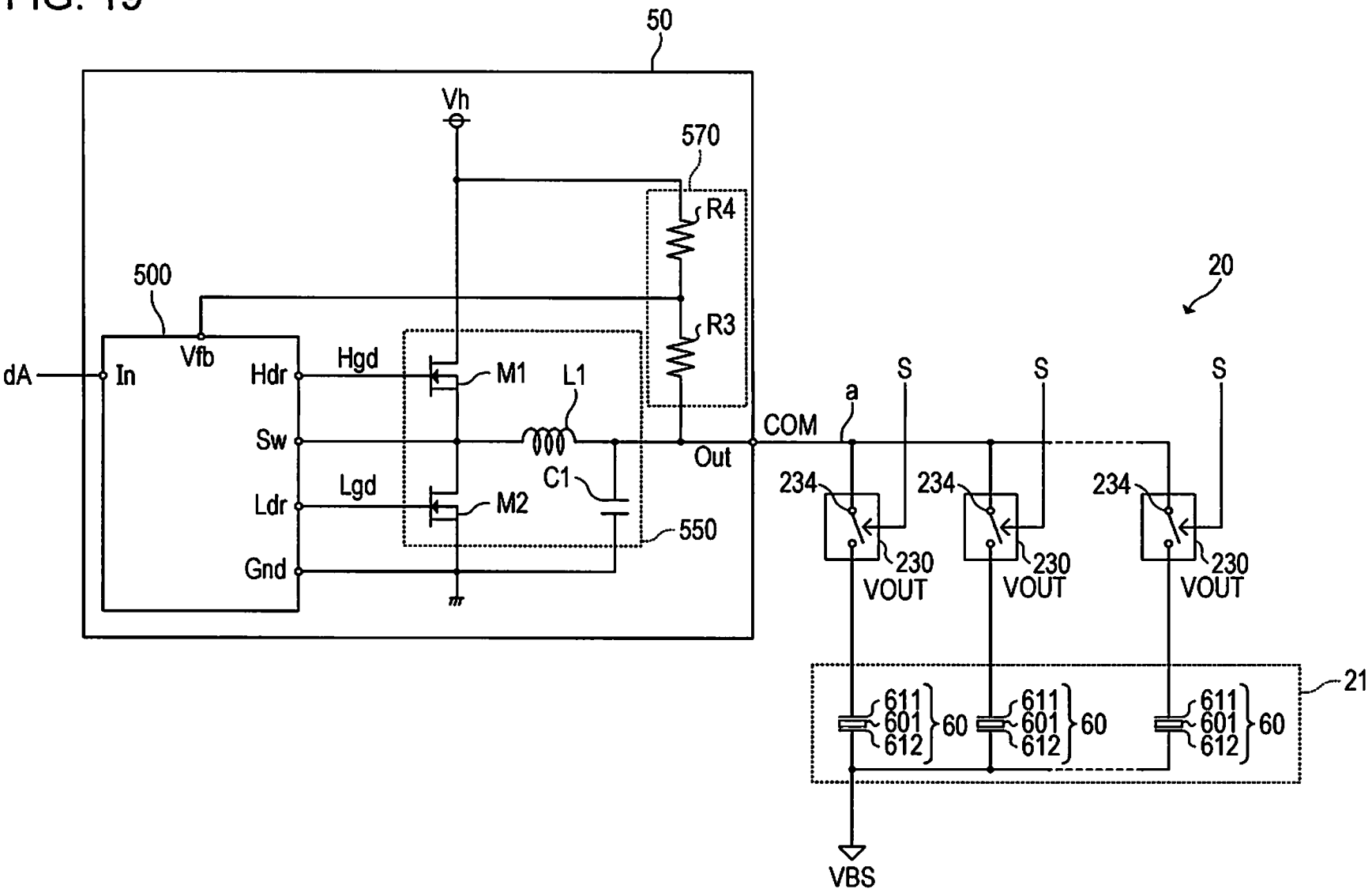
FIG. 19 is a configuration diagram illustrating a schematic configuration of a part of the liquid ejecting apparatus.

FIG. 19 is a configuration diagram illustrating a schematic configuration of a part of the liquid ejecting apparatus 1. FIG. 20 is a timing chart illustrating timing of the operations of the liquid ejecting apparatus 1 in the standby mode, the transition mode, and the sleep mode. FIG. 19 illustrates a simplified transfer gate (TG) 234 included in the selection circuit 230.

Figure 20:
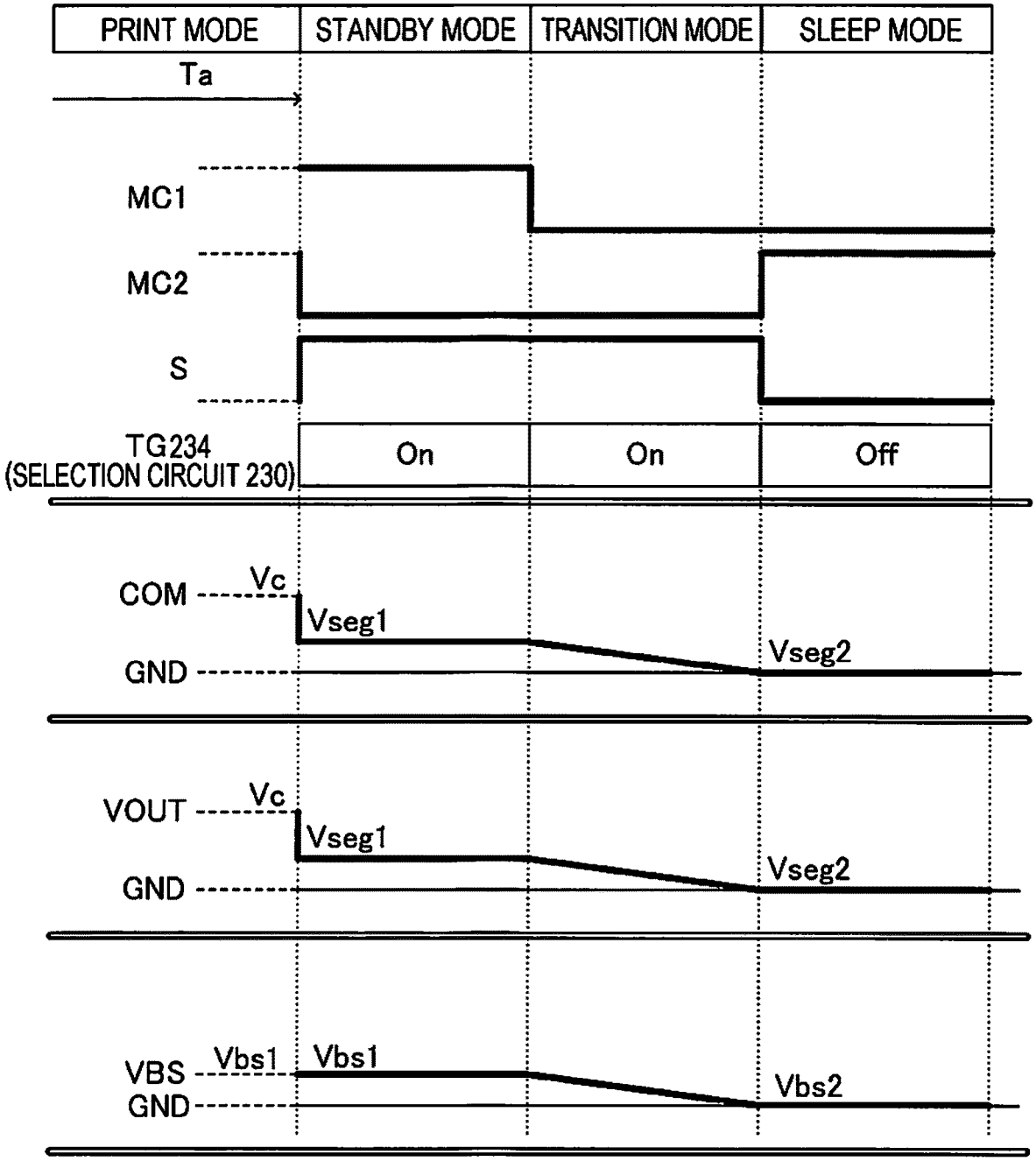
FIG. 20 is a timing chart illustrating timing of operations in the standby mode, the transition mode, and the sleep mode.

As illustrated in FIG. 20, if the print mode ends, the liquid ejecting apparatus 1 is shifted to the standby mode.

Specifically, the control circuit 100 makes the state signal MC2 go to an L level. Thereby, the selection signal S goes to an H level, and the transfer gate 234 is turned on.

In the standby mode, the control circuit 100 outputs data dA for causing the drive circuit 50 to generate the drive signal COM whose voltage value is the voltage Vseg1. The drive signal COM whose voltage value generated by the drive circuit 50 is the voltage Vseg1 is supplied to a node a to which the terminal Out and one end of the transfer gate 234 are connected. At this time, the voltage Vseg1 is controlled to approximate the voltage value of the reference voltage signal VBS.

Specifically, the data dA output from the control circuit 100 is a signal for controlling such that a duty ratio of the first amplification control signal Hgd output from the integrated circuit 500 is constant. At this time, the duty ratio of the first amplification control signal Hgd may be controlled to be equal to a ratio of the voltage value of the reference voltage signal VBS to the voltage Vh supplied to the drain of the first transistor M1. In detail, for example, the voltage Vh can be 42 V and the voltage value of the reference voltage signal VBS can be 5 V, a duty ratio of an H level of the first amplification control signal Hgd is controlled to be approximately 12% (≅5/42×100).

The voltage Vseg1 may not be equal to the voltage value of the reference voltage signal VBS. For example, a difference between the voltage Vseg1 and the voltage value of the reference voltage signal VBS may be controlled to be less than or equal to 2 V. Accordingly, for example, in a case where the voltage Vh is 42 V and the voltage value of the reference voltage signal VBS is 5 V, the voltage Vseg1 may be controlled between 3 V and 7 V. Thus, if the duty ratio of an H level of the first amplification control signal Hgd is controlled to be in the range from approximately 7% (×3/42×100) to approximately 17% (≅7/42×100).

Here, as described above, both the voltage values of the reference voltage signal VBS in the standby mode and the print mode are controlled to be the voltage Vbs1. As such, in the standby mode, by setting the voltage value of the reference voltage signal VBS supplied to the second electrode 612 of the piezoelectric element 60 to the same voltage Vbs1 as in the print mode, it is possible to reduce the time required for restarting print.

The liquid ejecting apparatus 1 is shifted to the transition mode, and thereafter, if a predetermined time elapses, the liquid ejecting apparatus is shifted to the standby mode.

Specifically, the control circuit 100 sets the state signal MC1 to an L level. Thereby, the selection signal S goes to the H level, and the transfer gate 234 is turned on.

In the transition mode, the voltage generation circuit 70 changes the voltage value of the reference voltage signal VBS which is generated from the voltage Vbs1 to the voltage Vbs2. The voltage Vbs2 is a voltage value in the sleep mode and is smaller than the voltage Vbs1. That is, in the transition mode, the voltage value of the reference voltage signal VBS is controlled to decrease.

The voltage value of the drive signal COM is controlled from the voltage Vseg1 to the voltage Vseg2 so as to follow the change in the voltage value of the reference voltage signal VBS. In other words, in the transition mode, the voltage value of the drive signal COM is controlled to approximate the voltage value of the reference voltage signal VBS.

Figure 21:
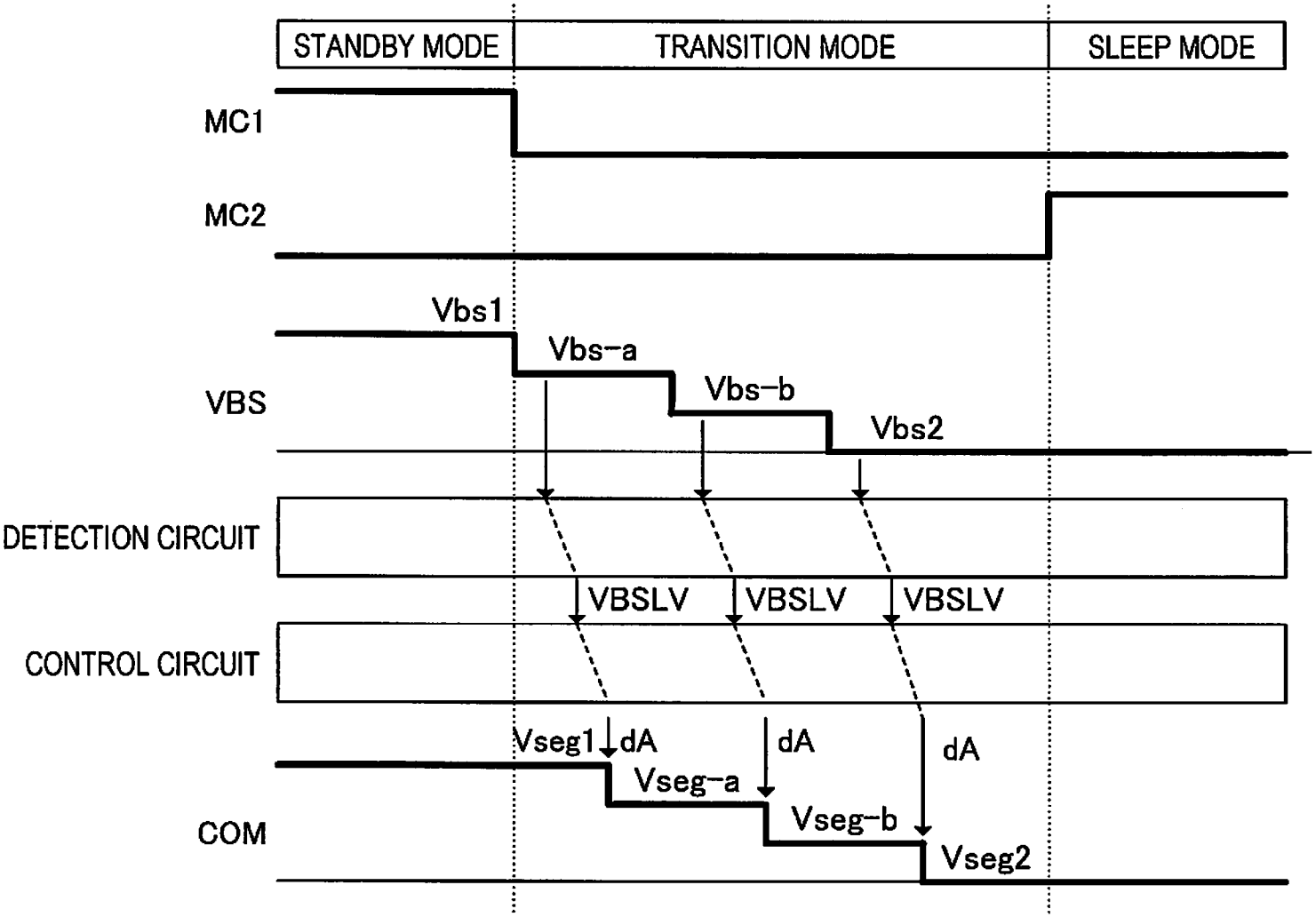
FIG. 21 is a diagram illustrating a relationship between a voltage value of the drive signal and a voltage value of the reference voltage signal in the transition mode.

FIG. 21 is a diagram illustrating a relationship between the voltage value of the drive signal COM and the voltage value of the reference voltage signal VBS in the transition mode.

If the standby mode is shifted to the transition mode, first, the voltage value of the reference voltage signal VBS changes from the voltage Vbs1 to the voltage Vbs-a lower than the voltage Vbs1. In the present embodiment, it is described that the voltage value of the reference voltage signal VBS is controlled by the voltage generation circuit 70, based on the state signals MC1 and MC2, but the voltage value of the reference voltage signal VBS may be configured to be controlled based on a signal output by the control circuit 100.

The detection circuit 80 detects the voltage Vbs-a and outputs the reference voltage value signal VBSLV indicating the detection result to the control circuit 100. For example, the detection circuit 80 may include an A/D converter (not illustrated), convert the voltage Vbs-a to a digital signal, and output the digital signal to the control circuit 100 as the reference voltage value signal VBSLV.

The control circuit 100 generates the data dA, based on the input reference voltage value signal VBSLV and outputs the data to the drive circuit 50. The data dA at this time controls the voltage value of the drive signal COM so as to become the voltage Vseg-a equal to the voltage Vbs-a. For example, the data dA may be a signal that controls the duty ratio of the first amplification control signal Hgd so as to becomes a ratio of the voltage value of the voltage Vbs-a to the voltage value of the voltage Vh.

The drive circuit 50 generates the drive signal COM whose voltage value is the voltage Vseg-a, based on the input data dA, and outputs the drive signal to the node a.

Thereafter, the voltage value of the reference voltage signal VBS becomes a voltage Vbs-b lower than the voltage Vbs-a from the voltage Vbs-a.

The detection circuit 80 detects the voltage Vbs-b and outputs the reference voltage value signal VBSLV indicating the detection result to the control circuit 100.

The control circuit 100 generates the data dA, based on the input reference voltage value signal VBSLV and outputs the data to the drive circuit 50. The data dA at this time is controlled such that the voltage value of the drive signal COM becomes the voltage Vseg-b equal to the voltage Vbs-b. For example, the data dA may be a signal that controls the duty ratio of the first amplification control signal Hgd so as to be a value equal to a ratio of the voltage value of the voltage Vbs-b to the voltage value of the voltage Vh.

The drive circuit 50 generates the drive signal COM whose voltage value is the voltage Vseg-b based on the input data dA and outputs the drive signal to the node a.

Thereafter, the voltage value of the reference voltage signal VBS becomes a voltage Vbs2 lower than the voltage Vbs-b from the voltage Vbs-b.

The detection circuit 80 detects the voltage Vbs2 and outputs the reference voltage value signal VBSLV indicating the detection result to the control circuit 100.

The control circuit 100 generates the data dA, based on the input reference voltage value signal VBSLV and outputs the data to the drive circuit 50. The data dA at this time is a signal for controlling the voltage value of the drive signal COM so as to become the voltage Vseg2 equal to the voltage Vbs2. For example, the data dA may be a signal that controls the duty ratio of the first amplification control signal Hgd so as to become a value equal to a ratio of the voltage value of the voltage Vbs2 to the voltage value of the voltage Vh.

The drive circuit 50 generates the drive signal COM whose voltage value is the voltage Vseg2, based on the input data dA and outputs the data to the node a.

Thereafter, the voltage value of the reference voltage signal VBS maintains the voltage Vbs2.

The control circuit 100 outputs the data dA for controlling the voltage value of the drive signal COM so as to become the voltage Vseg2, and after a predetermined time elapses, the transition mode is shifted to the sleep mode.

In the present embodiment, it is described that the voltage value of the reference voltage signal VBS changes via the voltage values of two stages of the voltages Vbs-a and Vbs-b until the voltage value of the reference voltage signal VBS changes from the voltage Vbs1 to the voltage Vbs2, but the voltage value of the reference voltage signal VBS may change via the voltage values of three stages or more, or may change via only one voltage value.

If the liquid ejecting apparatus 1 is shifted to the sleep mode, the control circuit 100 sets the state signal MC2 to an H level. Thereby, the selection signal S goes to an L level, and the transfer gate 234 is turned off.

In the sleep mode, the control circuit 100 outputs the data dA for causing the drive circuit 50 to generate the drive signal COM whose voltage value is the voltage Vseg2. The drive signal COM whose voltage value is the voltage Vseg2 generated by the drive circuit 50 is supplied to the node a. At this time, the voltage Vseg2 is controlled to approximate the voltage Vbs2 of the reference voltage signal VBS.

For example, the data dA may be controlled such that the duty ratio of the first amplification control signal Hgd becomes a value equal to a ratio of the voltage value of the voltage Vbs2 to the voltage value of the voltage Vh.

Here, in the sleep mode, it is required to reduce power consumption. Thus, it is preferable that an operation of the voltage generation circuit 70 stop. That is, it is preferable that the voltage Vbs2 of the reference voltage signal VBS in the sleep mode be controlled to be a ground potential (0 V). Thus, it is preferable that the duty ratio of an H level of the first amplification control signal Hgd be controlled to be 0%, in other words, the second transistor M2 is controlled to keep an on state. Thereby, it is possible to further reduce the power consumption of the liquid ejecting apparatus 1 in the sleep mode.

As described above, in the liquid ejecting apparatus 1, the transfer gate 234 is controlled to be turned off, and the voltage value of the drive signal COM is controlled to approximate the voltage value of the reference voltage signal VBS, in the sleep mode. Thereby, it is possible to reduce the potential difference between the first electrode 611 and the second electrode 612 of the piezoelectric element 60, that is, the potential difference Vdiff represented by Equation (2). Thus, it is possible to reduce the amount of displacement of the piezoelectric element 60 and the vibration plate 621.

Furthermore, even in a case where the resistance component Rpz of the piezoelectric element 60 is larger than the resistance component Rtg of the transfer gate 234 because the piezoelectric element 60 is provided with a high density, the amount of displacement of the piezoelectric element 60 in the sleep mode can be reduced, and thus, it is possible to reduce the stress applied to the piezoelectric element 60 and the vibration plate 621.

In the standby mode and the sleep mode as well, the detection circuit 80 detects the voltage value of the reference voltage signal VBS in each predetermined detection period and outputs the reference voltage value signal VBSLV indicating the detection result to the control circuit 100, and the control circuit 100 may generate the data dA, based on the input reference voltage value signal VBSLV, in the same manner as in the transition mode.

Thereby, even in a case where the voltage value of the reference voltage signal VBS varies in the standby mode and the sleep mode, the voltage value of the drive signal COM can be controlled to approximate the voltage value of the reference voltage signal VBS, and thus, it is possible to further reduce the amount of displacement of the piezoelectric element 60.

In the sleep mode, the detection circuit 80 may detect the voltage value of the reference voltage signal VBS in a detection period longer than a detection period of the standby mode. Thereby, an operation power of the detection circuit 80 is reduced in the sleep mode, and thus, it is possible to reduce the overall power consumption.

As illustrated in FIGS. 5 and 19, the drive circuit 50 includes the first feedback circuit 570 which feeds back the drive signal COM that is pulled up to the high voltage Vh and is output from the terminal Out. That is, the voltage Vh having a voltage value higher than the voltage value of the drive signal COM and the voltage value of the reference voltage signal VBS is input to the node a via the resistor R3 and the resistor R4 which are resistance elements included in the first feedback circuit 570. Accordingly, in a case where the drive signal COM output to the node a by the drive circuit 50 is not controlled, a signal whose voltage value based on the high voltage Vh is undefined is supplied to the node a.

If the transfer gate 234 is controlled to be turned on in a state where a signal having the undefined voltage value is supplied to the node a, the voltage signal having the undefined voltage value is supplied to the first electrode 611, and thereby, an unintended displacement may occur in the piezoelectric element 60. Alternatively, if the transfer gate 234 is controlled to be turned off, an unintended voltage is supplied to the first electrode 611 due to a leakage current based on the signal whose voltage value is undefined, and thereby, an unintended displacement may occur in the piezoelectric element 60.

In the present embodiment, in the print mode, the drive signal COM configured by a voltage waveform in which voltage waveforms Adp, Bdp, and Cdp are consecutive is supplied to the node a. In addition, in the standby mode, the drive signal COM controlled to approximate the voltage Vbs1 which is the voltage value of the reference voltage signal VBS is supplied to the node a. In addition, in the transition mode, the drive signal COM controlled to approximate the voltage value of the reference voltage signal VBS which changes from the voltage Vbs1 to the voltage Vbs2 is supplied to the node a. In addition, in the sleep mode, the drive signal COM controlled to approximate the voltage Vbs2 which is the voltage value of the reference voltage signal VBS is supplied to the node a.

As described above, the voltage signal supplied to the node a in the liquid ejecting apparatus 1 according to the present embodiment is controlled by the drive signal COM in any of the print mode, the standby mode, the transition mode, and the sleep mode. Thus, an unintended voltage is not supplied to the first electrode 611 of the piezoelectric element 60, and a possibility that an unintended displacement occurs in the piezoelectric element 60 is reduced.

6. Modification Example

In the above embodiment, the detection circuit 80 detects the reference voltage signal VBS in the transition mode, generates the reference voltage value signal VBSLV, and outputs the reference voltage value signal to the control circuit 100. However, the detection circuit 80 may detect the drive signal COM and the reference voltage signal VBS in the transition mode and may output the reference voltage value signal VBSLV indicating a difference to the control circuit 100. Thereby, it is possible to make the voltage value of the drive signal COM in the transition mode closer to the voltage value of the reference voltage signal VBS. Furthermore, the same control may be performed even in the standby mode and the sleep mode.

In the above-described embodiment, the liquid ejecting apparatus 1 is configured as a serial type ink jet printer in which the head unit 20 including the ejection unit 600 is provided in the carriage 24 and printing is performed on the medium P by moving the carriage 24, but the liquid ejecting apparatus 1 may be a line head type ink jet printer in which a plurality of the recording heads 21 are provided in the direction X which is a main scan direction orthogonal to a transport direction of the medium P, and printing is performed by merely transporting the medium P.

Although the embodiments and the modification example are described above, the invention is not limited to the embodiments, and can be implemented in various types without departing from a gist thereof. For example, the above-described embodiments can be combined as appropriate.

The invention includes substantially the same configuration as the configuration (for example, a configuration having the same function, method, and result, or a configuration having the same object and effect) described in the embodiment. In addition, the invention includes a configuration in which a non-essential part of the configuration described in the embodiment is replaced. In addition, the invention includes a configuration that achieves the same operation and effect as the configuration described in the embodiment, or a configuration that can achieve the same object. In addition, the invention includes a configuration in which a well-known technique is added to the configuration described in the embodiment.

What is claimed is:

1. A liquid ejecting apparatus comprising:

a drive circuit in which a first voltage signal is output from an output terminal;

a piezoelectric element that includes a first electrode to which the first voltage signal is supplied and a second electrode to which a second voltage signal is supplied and is displaced by a potential difference between the first electrode and the second electrode;

a cavity which is filled with a liquid that is ejected from a nozzle in accordance with the displacement of the piezoelectric element;

a vibration plate that is provided between the cavity and the piezoelectric element; and a switch element that is electrically connected to the output terminal and the first electrode, wherein the liquid ejecting apparatus has a mode in which a liquid is not ejected, the switch element is controlled to be turned off, and a voltage value of the first voltage signal is controlled to approximate a voltage value of the second voltage signal.

2. The liquid ejecting apparatus according to claim 1, wherein a plurality of the nozzles are provided at a density of 300 or more per inch, and wherein a plurality of the piezoelectric elements are provided corresponding to the plurality of nozzles.

3. The liquid ejecting apparatus according to claim 1, wherein printing is not performed on a medium in the mode.

4. The liquid ejecting apparatus according to claim 1, wherein a third voltage signal having a voltage value higher than the voltage value of the first voltage signal and the voltage value of the second voltage signal is input to a node which is electrically connected to the output terminal and the switch element, via a resistance element.

5. The liquid ejecting apparatus according to claim 1, wherein a resistance component of the piezoelectric element is larger than a resistance component when the switch element is turned off.

6. The liquid ejecting apparatus according to claim 1, wherein the drive circuit includes a feedback circuit that feeds back the first voltage signal which is output from the output terminal;

a modulation circuit that generates a modulation signal, based on an original signal which is a source of the first voltage signal and a signal which is obtained by feeding back the first voltage signal; and an output circuit that generates the first voltage signal by amplifying and demodulating the modulation signal.

7. The liquid ejecting apparatus according to claim 1, further comprising a control circuit configured to control the drive circuit and the switch element so as to decrease a voltage value of the first voltage signal before turning off the switch element so that the liquid ejecting apparatus has the mode in which the liquid is not ejected, the switch element is controlled to be turned off, and the voltage value of the first voltage signal is controlled to approximate the voltage value of the second voltage signal.

8. The liquid ejecting apparatus according to claim 1, further comprising a voltage generation circuit configured to variably control the voltage of the second voltage signal.

9. The liquid ejecting apparatus according to claim 8, further comprising a control circuit configured to output a state signal to the voltage generation circuit and the switch element, wherein the voltage generation circuit is configured to vary the voltage value of the second voltage signal according to the state signal, and the switch element is configured to be turned on or off according to the state signal.

* * * * *